US005933163A

United States Patent [19]

Koizumi et al.

[11] Patent Number: 5,933,163

[45] Date of Patent: Aug. 3, 1999

[54] INK JET RECORDING APPARATUS

[75] Inventors: Yutaka Koizumi, Yokohama; Hiroshi Sugitani, Machida; Masaki Inaba, Kawasaki; Masami Ikeda, Yokohama; Masami Kasamoto, Ayase; Tsuyoshi Orikasa, Musashimurayama; Makiko Kimura, Sagamihara; Toshio Kashino, Chigasaki; Seiichiro Karita, Yokohama; Shuji Koyama, Kawasaki; Haruhiko Terai, Yokohama; Kimiyuki Hayasaki, Yokohama; Akira Goto, Yokohama; Kouichi Omata; Takayuki Ono, both of Kawasaki, all of Japan

[73] Assignee: Canon Kabushiki Kaisha, Tokyo, Japan

[21] Appl. No.: 08/980,401

[22] Filed: Nov. 28, 1997

Related U.S. Application Data

[63] Continuation of application No. 08/398,941, Mar. 2, 1995, abandoned.

[30] Foreign Application Priority Data

| | | | |
|---|---|---|---|
| Mar. 4, 1994 | [JP] | Japan | 6-034810 |
| Mar. 4, 1994 | [JP] | Japan | 6-034930 |
| Mar. 30, 1994 | [JP] | Japan | 6-060914 |
| May 19, 1994 | [JP] | Japan | 6-105469 |

[51] Int. Cl.[6] ..... B41J 2/05

[52] U.S. Cl. ..... 347/42; 347/63

[58] Field of Search ..... 347/42, 63, 65, 347/85, 20

[56] References Cited

U.S. PATENT DOCUMENTS

| | | | |
|---|---|---|---|
| 4,412,224 | 10/1983 | Sugitani . | |
| 4,419,677 | 12/1983 | Kasugayama | 347/87 |
| 4,419,678 | 12/1983 | Kasugayama | 347/86 |
| 4,437,100 | 3/1984 | Sugitani et al. . | |
| 4,450,455 | 5/1984 | Sugitani et al. . | |
| 4,499,480 | 2/1985 | Takatori | 347/42 |
| 4,558,333 | 12/1985 | Sugitani et al. . | |
| 4,568,953 | 2/1986 | Aoki et al. . | |
| 4,609,427 | 9/1986 | Inamoto et al. . | |
| 4,611,219 | 9/1986 | Sugitani et al. . | |
| 4,694,307 | 9/1987 | Toganoh | 347/42 X |
| 4,829,324 | 5/1989 | Drake et al. | 347/42 |
| 4,994,825 | 2/1991 | Saito et al. . | |
| 5,006,867 | 4/1991 | Koizumi et al. . | |
| 5,057,854 | 10/1991 | Pond et al. | 347/42 |
| 5,065,170 | 11/1991 | Rezanka et al. | 347/42 |
| 5,095,321 | 3/1992 | Saito et al. . | |
| 5,098,503 | 3/1992 | Drake | 156/299 |
| 5,148,192 | 9/1992 | Izumida et al. . | |
| 5,148,194 | 9/1992 | Asai | 347/49 |
| 5,160,403 | 11/1992 | Fisher | 347/42 X |
| 5,164,747 | 11/1992 | Osada et al. . | |
| 5,172,134 | 12/1992 | Kishida et al. . | |

(List continued on next page.)

FOREIGN PATENT DOCUMENTS

| | | | |
|---|---|---|---|
| 0419180 | 3/1993 | European Pat. Off. | B41J 2/05 |
| 605006 | 7/1994 | European Pat. Off. | B41J 2/16 |
| 55-132253 | 10/1980 | Japan | B41J 3/04 |
| 2-2009 | 1/1990 | Japan | B41J 2/05 |
| 3-184860 | 8/1991 | Japan | B41J 2/05 |
| 4-229278 | 8/1992 | Japan | B41J 2/16 |
| 4-232749 | 8/1992 | Japan | B41J 2/045 |
| 5-24192 | 2/1993 | Japan | B41J 2/045 |
| 2110994 | 6/1983 | United Kingdom | B41J 3/04 |

*Primary Examiner*—Joseph Hartang
*Attorney, Agent, or Firm*—Fitzpatrick, Cella, Harper & Scinto

[57] ABSTRACT

An ink jet recording head for effecting recording with ejection of ink includes a plurality of element substrates each having a plurality of ejection energy generating elements for ejecting the ink; a base plate for supporting the plurality of element substrates on one surface thereof in an array; a grooved member having a length corresponding to a length of the array and having passages corresponding to the ejection energy generating elements of the plurality of element substrates.

36 Claims, 18 Drawing Sheets

U.S. PATENT DOCUMENTS 5,175,565 12/1992 Ishinaga et al. .
5,192,959 3/1993 Drake et al. ..... 347/42
5,199,470 4/1993 Goldman ..... 141/1
5,208,604 5/1993 Watanabe et al. .
5,218,754 6/1993 Ranagappan ..... 29/611
5,243,755 9/1993 Inaba et al. .
5,281,980 1/1994 Kishida et al. .
5,322,811 6/1994 Komuro ..... 347/59 X
5,343,227 8/1994 Hirosawa et al. ..... 347/42
5,361,087 11/1994 Tajima et al. .
5,365,255 11/1994 Inoue et al. .
5,371,528 12/1994 Izumida et al. .
5,373,633 12/1994 Satoi et al. .
5,389,957 2/1995 Kimura et al. .
5,510,820 4/1996 Aulick ..... 347/85

INK JET RECORDING APPARATUS

This application is a continuation of application Ser. No. 08/398,941, filed Mar. 2, 1995, now abandoned.

FIELD OF THE INVENTION AND RELATED ART

The present invention relates to liquid jet head, an ink jet recording head using ink as the liquid, an ink jet head cartridge having the ink jet head, an ink jet recording apparatus, more particularly to the ink jet recording head, the ink jet head cartridge using the same, and an ink jet head kit, and an ink jet recording apparatus, in which the recording head is elongated having a plurality of substrate having ejection energy generating elements. The present invention also relates to a manufacturing method for the ink jet head. Additionally, it relates to a method of injecting the ink into an ink container.

The present invention is applicable not only to a printer used in an office, or a printer for textile printing.

A recording apparatus such as a printer, copying machine or facsimile machine, is so constructed that on the basis of image information, an image of dot pattern is formed on a recording material such as paper, plastic thin plate, textile or the like.

The recording apparatus can be classified, on the basis of the recording system, an ink jet type, a wire dot type, a thermal type, an electrophotographic type or the like. Among them, an ink jet type (ink jet printing apparatus) is constructed such that recording liquid (ink) droplet is ejected through an ejection outlet of an ink jet recording head onto a recording material.

The ink jet type has the advantages that the high speed recording is possible with low nozzle, that a wide range of recording materials are usable, and that the color image recording is easily accomplished, and therefore, it is widely used recently.

Among the ink jet type, a thermal ink ejecting type recording head using pressure resulting from thermal expansion produced by application of thermal energy to the ink, is advantageous in that the responsivity to the recording signal is high that the density of the ejection outlets can be increased without difficulty.

In the thermal energy ink ejection type, it is particularly expected from the standpoint of the high speed recording that a long full-line type recording head (full-line recording head) covering an entire width of the recording material by having ejection outlets and corresponding electrothermal transducers (ejection energy generating elements). However, in the manufacturing of such a line recording head, it has been very difficult to manufacture it without any defect in the ejection energy generating element all over the entire width of the recording area.

More particularly, in the case of a line recording head covering A3 size recording sheet at the density of 400 dpi (dot per inch), 4736 ejection energy elements a pair of electrodes and a heat generating resistor therebetween (in the case of the thermal ink ejection type) have to be provided without any one defect, which is very difficult. Therefore, the head cost is very high with the result of difficulty putting it into practice.

Heretofore, various proposals have been made.

For example, Japanese Laid-Open Patent Applications Nos. 132253/1980, 2009/1990, 229278/1992, 232749/1992, 24192/1993, have proposed that relatively easily manufacturable heads having 32, 48, 64 and 128 ejection outlets, are connected on the top and bottom surface one supporting member with high precision in according with the nozzles density.

More particularly, the recording heads are disposed in a stack as manner on the opposite surfaces of the supporting material to provide one long ink jet head. With this method, the relatively small heads are disposed on the opposite surfaces of the supporting member, and therefore, there exist a marginal area on each side. For this reason, the heads can be relatively easily mounted by head mounting means so that there is a relatively high latitude in the design of the head arrangement. However, in the recording head of this structure, the electric signals required for driving the head and the ink to be ejected, have to be supplied to both sides of the supporting member, with the result of very high manufacturing cost. In addition, the size of the ink jet head is large because small heads are disposed on the both sides of the supporting member. Additionally, each part, particularly the supporting member for the small heads, is required to be very high accuracy in the flatness on each side, the parallelism between the sides, the distance between the surfaces, with the result of very high cost.

In another method, a plurality of small heads as disclosed in Japanese Laid-Open Patent Application No. 229278/1992 are disposed on one side of the substrate to provide an elongated head. With this method, the above-described drawbacks are partly removed. However, with respect to the ink supply system, the ink has still to be supplied to the individual small heads with the result of high cost. What is more difficult is that the ink leakage has to be prevented at both sides of the small heads. In this long head, the small heads are arranged without changing the nozzle pitch, and therefore, at the opposite sides of a small head, the tolerance thereat is less than only one half the nozzle pitch. For example, when the nozzle pitch corresponds to 400 dpi (63.5 $\mu$m), the distance between the center of the end nozzle and the side surface is required to be not more than 63.5/2=30 $\mu$m. This includes one half of the nozzle width. If it is 12 $\mu$m, the rest is less than 18 $\mu$m. What is requires is to seal for preventing the ink leakage with this dimension, which is highly difficult with the result of very high manufacturing cost of the recording head.

The foregoing is the explanation of the problems with the manufacturing for the two types of the recording heads. From this standpoint of designing, the following problems are involved. In both of the types, a plurality of small heads are arranged, and therefore, the small heads are positioned with tolerance with the result of small difference in the ink ejecting directions (front-back, left-right, and angular deviations). This may result in non-uniform printing as a hole of the ink jet head. Amounts of ink ejected are also slightly different, which may result in printing non-uniformity. Therefore in order to provide high quality image, the individual heads are exchanged through trial and error to finally provided one satisfactory long head. This also increases the cost.

SUMMARY OF THE INVENTION

Accordingly, it is a principal object of the present invention to provide a small size and inexpensive recording apparatus capable of effecting high speed and high quality printing.

It is another object of the present invention to provide an ink jet head manufacturing method for manufacturing an ink jet head with high yield and low cost.

It is another object of the present invention to provide a small size inexpensive ink jet head capable of effecting printing with high quality and high speed.

It is a further object of the present invention to provide an ink jet head kit and an ink refilling method into an ink container, by which the ink jet head can be repeatedly usable by refilling ink, so that the running cost can be reduced.

According to an aspect of the present invention, there is provided an ink jet recording head for effecting recording with ejection of ink comprising: a plurality of element substrates each having a plurality of ejection energy generating elements for ejecting the ink; a base plate for supporting the plurality of element substrates on one surface thereof in an array; a grooved member having a length corresponding to a length of the array and having passages corresponding to the ejection energy generating elements of the plurality of element substrates.

According to another aspect of the present invention, there is provided a liquid ejection recording head for ejecting liquid comprising: a plurality of element substrates each having a plurality of ejection energy generating elements for ejecting the liquid; a base plate for supporting the plurality of element substrates on one surface thereof in an array; a grooved member having a length corresponding to a length of the array and having passages corresponding to the ejection energy generating elements of the plurality of element substrates.

According to a further aspect of the present invention, there is provided an ink jet recording apparatus for effecting recording with ejection of ink comprising: an ink jet recording head for effecting recording with ejection of ink including a plurality of element substrates each having a plurality of ejection energy generating elements for ejecting the ink; a base plate for supporting the plurality of element substrates on one surface thereof in an array; a grooved member having a length corresponding to a length of the array and having passages corresponding to the ejection energy generating elements of the plurality of element substrates; and driving signal supplying means for supplying a driving signal for driving the ejection energy generating elements.

According to a yet further aspect of the present invention, there is provided an ink jet head kit comprising: an ink jet recording head for effecting recording with ejection of ink including a plurality of element substrates each having a plurality of ejection energy generating elements for ejecting the ink; a base plate for supporting the plurality of element substrates on one surface thereof in an array; a grooved member having a length corresponding to a length of the array and having passages corresponding to the ejection energy generating elements of the plurality of element substrates; an ink container for containing ink to be supplied to the ink jet recording head; and ink filling means for filling the ink to the ink container.

According to a further aspect of the present invention, there is provided an ink jet head manufacturing method comprising the steps of: a step of arranging a plurality of element substrates each having a plurality of ejection energy generating elements on a base member; a step of coupling, with the plurality of element substrates, a grooved member having a length corresponding to an array of the plurality of element substrates and having the plurality of grooves for constituting passages corresponding to the ejection energy generating elements.

According to a yet further aspect of the present invention, convenient ink filling method is provided.

According to an aspect of the present invention, the necessity for using one long recording head involving low yield, is eliminated, and high yield heads having 64 or 128 ejection energy generating elements are usable, and therefore, the yield of the recording heads and the low cost manufacturing are accomplished. Additionally, even if a plurality of substrates are used, the grooved member is common, and therefore, the directions of the passage and the ejection outlets are made uniform as compared with the structure using small heads each having the substrate and the top plate, and therefore, a long head capable of providing good images can be manufactured with low cost.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

In the following description, the liquid is ink liquid, but the present invention is not limited to this.

In this invention, the recording means not only the recording of characters or letters or meaningful image, but includes meaningless patterns.

The recording material may be, paper, plastic sheet, plastic plate, textile, strings, wood, leather, metal plate on which the ink can be applied by the recording head.

Figure 1:
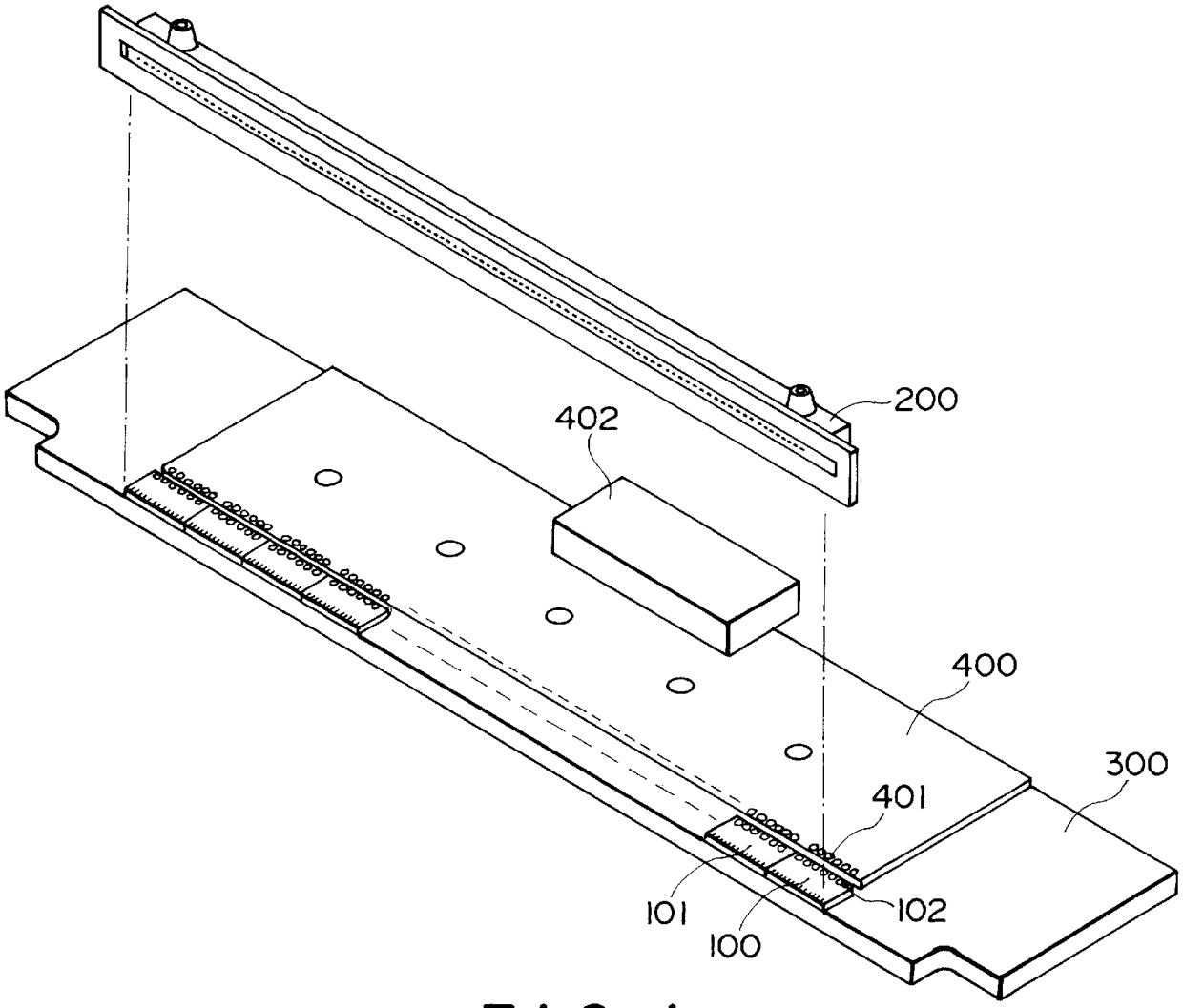
FIG. 1 is a schematic perspective view of an ink jet recording head.

Referring to FIG. 1, there is shown major parts of an ink jet head according to an embodiment of the present invention. In this embodiment, the ink jet head has 3008 nozzles (printing width of 212 mm) at a density of 360 dpi (70.5 $\mu$m).

A substrate (heater board) 100 has 128 ejection energy generating elements 101 thereon at predetermined positions at the density of 360 dpi. In this embodiment, the element is in the form of a heat generating resistor for generating energy can be applied to the ink. The heater board is provided with signal pads for receiving external signals for driving the ejection energy generating elements 101 at proper timings and width electric energy supply pads 102 for supplying electric energy for driving the ejection energy generating elements 101. The heater board is also provided with function elements such as shift resister or the like functioning to output parallel signals to the ejection energy generating elements on the basis of serious input signals.

Examples of the material of the substrate include monocrystal silicon, polycrystal silicon glass, metal or ceramic material in the form of a plate.

The heater board 100 is bonded and fixed by adhesive material on a surface of a supporting member (base plate, 300 of aluminum, stainless steel or another metal or ceramic material).

Figure 2:
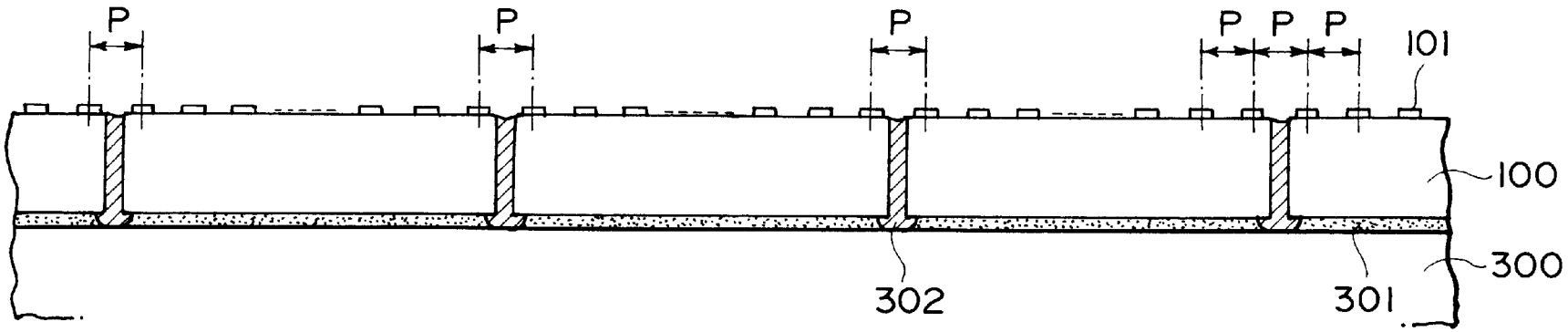
FIG. 2 is a schematic view illustrating arrangement of a heater board for an ink jet recording head according to an embodiment of the present invention.

FIG. 2 illustrates a state in which a plurality of heater boards 100 are disposed on one side of the base plate 300 with small gap between adjacent ones, into an array. The heater boards 100 are bonded and fixed by the adhesive material 301 applied with a predetermined thickness thereon at predetermined positions on the base plate 300. The heater boards are bonded with such a high accuracy that an interval between adjacent end ejection energy generating elements of adjacent heater boards is substantially equal to the interval between adjacent ejection energy generating elements within the heater board 100 (P=70.5 $\mu$m). The gap between the adjacent heater boards may be as it is, if the ink does not leak, but in this embodiment, it is sealed with a sealant 302.

In FIG. 1, the base plate 300 is provided with a wiring board 400 by an adhesive material, similarly to the heater board 100. A predetermined positional relationship is established between the pads 102 on the heater board 100 and the signal and electric energy supplying pads 401 on the wiring board. The wiring board is also provided with a connector 402 for supplying the external printing signals and driving electric energy.

The description will be made as to grooved top plate 200.

As shown in FIG. 3, the top plate 200 is provided with grooves for constituting ink passages corresponding to ejection energy generating elements 101 on the heater boards 100 orifices 203 in fluid communication with the associated passages to eject the ink toward the recording material, a recess 201 for constituting a liquid chamber in fluid communication with the plurality of passages for supplying the ink to the passages 202, and an ink supply port 204 for receiving the ink from an ink container (not shown). The top plate 200 is long enough to cover all the ejection energy generating elements on the all of the heater boards 100 (a length corresponding to the array of the ejection energy generating elements).

In this invention, the top plate 200 shown in FIG. 1, the top plate 200 is connected with the heater board in such a manner that a predetermined positional relationship is established between the passages 202 and the ejection energy generating elements 101 on the heater board 100 on the base plate 300. The material of the top plate 200 may be any, if the grooves can be formed correctly. Preferably, it has high mechanical strength, high dimensional stability and high durability against the ink. Examples of preferable materials include epoxy resin, acrylic resin, diglycol resin, dialkylcarbonate resin, unsaturated polyester resin, polyurethane resin, polyimide resin, melamine resin, phenol resin, urea resin materials. Particularly, polysalphon, polyethersalphon or the like is used because of the moldability and durability against the liquid.

The description will be made as to the connection between the top plate and the support for the heater boards.

On the base plate 300, a plurality of heater boards 100 are bonded and connected with a predetermined dimensional relation.

Figure 4:
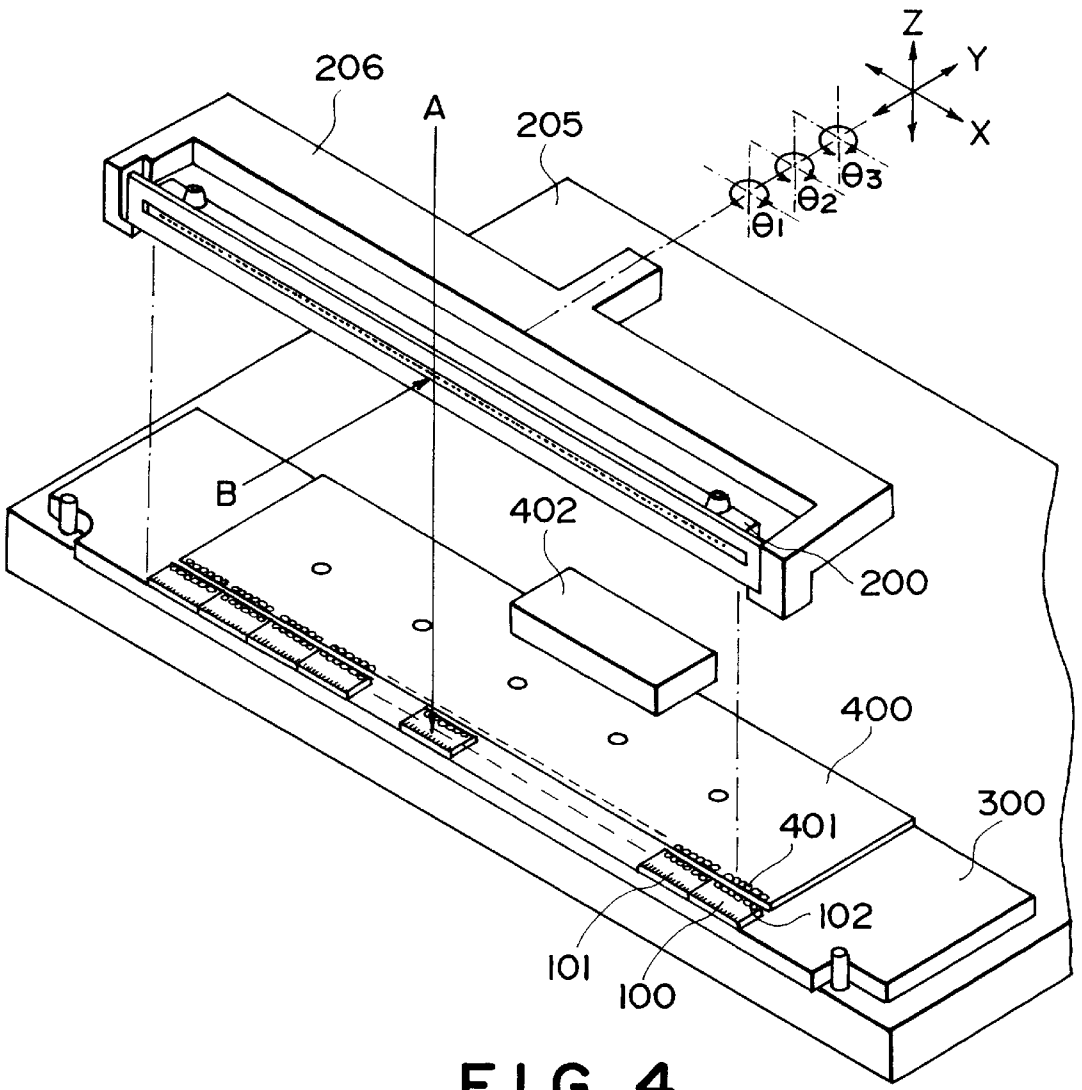
FIG. 4 illustrates a manufacturing step of the ink jet recording head according to the embodiment.

Subsequently, as shown in FIG. 4, the above-described base plate is placed on a base 205 at a predetermined position, of a clamping machine (the entirety thereof is not shown). The position of the base plate is determined to be constant by pins on the base 205. Subsequently, the top plate 200 is placed on a hand 206 of the clamping or connecting machine. The top plate 200 is also placed on the hand 206 at the predetermined position, so that the positional relations therebetween are assured to a certain degree by placing the base plate 300 and the top plate 200 on the base 205 and the hand 206 in this manner. Subsequently, the positional relationship is checked with a microscope of the clamping machine. First, the 1504th heater 101 (one half of the number of ejection nozzles 3008) is checked in a direction A. In other words, the position is correctly determined for the heater in the direction A by the clamping machine, through image processing process. Then, an orifice corresponding to the 1504th nozzle with checked in a direction B. The positional relation is adjusted in the direction X such that the position determined in the direction B is aligned with the position observed in the direction A.

Figure 5:
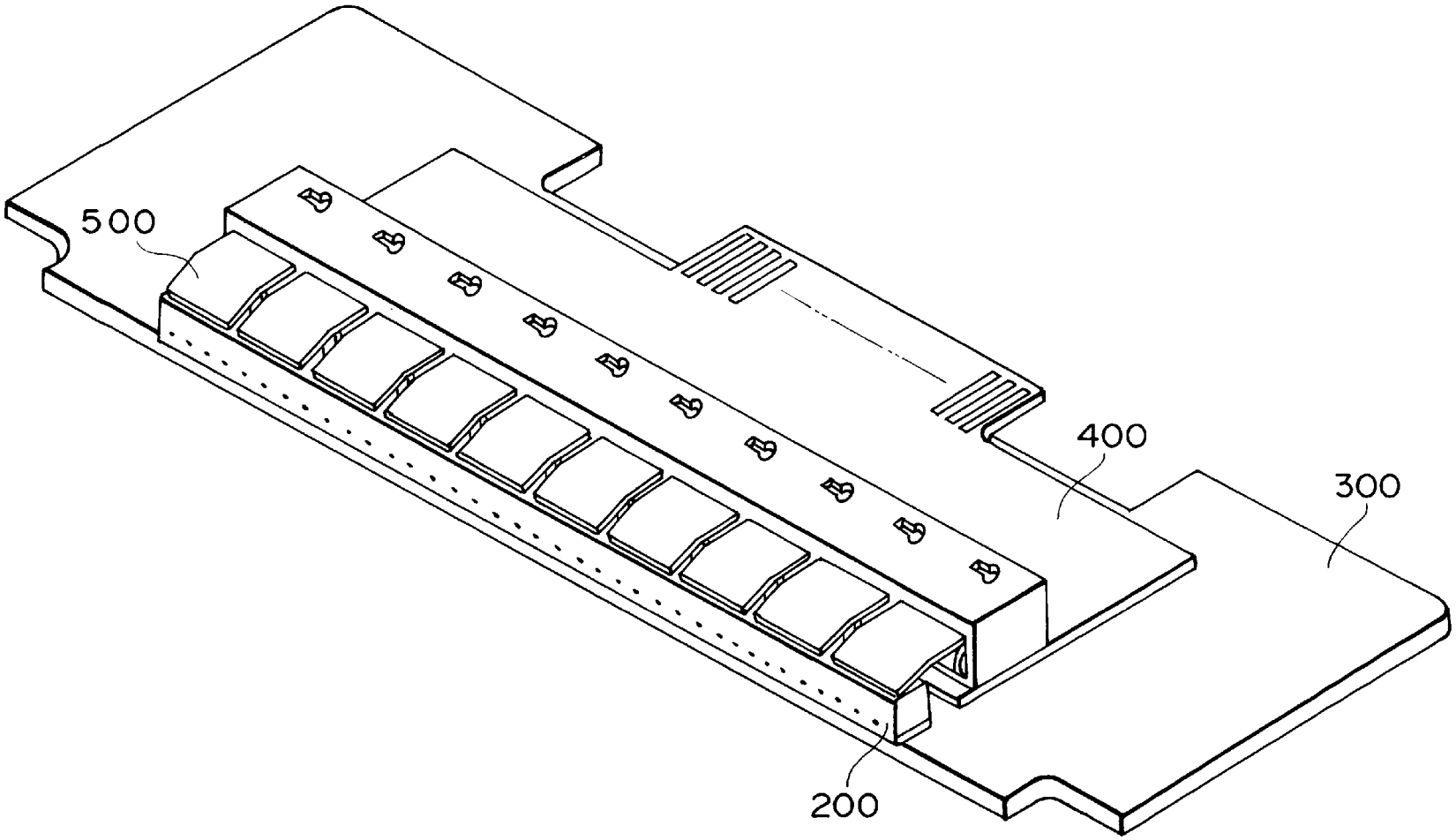
FIG. 5 is a schematic perspective view of an ink jet recording head according to the present invention.

The position adjustment accuracy of the clamping machine is ±2 $\mu$m, and therefore, this accuracy is assured in the positioning in the direction X. Subsequently, the hand 206 is lowered in the direction Z while maintaining the positional accuracy, so that the top plate 200 is clamped on the heater board 100. The hand 206 is removed while pressing the top plate in the direction B (y), and then they are fixed together by a spring 500 (FIG. 5).

In this embodiment, the clamping method uses mechanical element such as spring, but another method is usable for example using an adhesive material alone or in combination with the spring. In any event, the top plate 200 and the heater board 100 are fixed with the relationship shown in FIG. 6.

The top plate 200 described in the foregoing may be manufactured through a known method such as, machining (cutting), molding, injection, photolithography or the like.

As described in the foregoing, a long grooved top plate is mounted on a head member having a plurality of heater boards each provided with a plurality of energy generating elements, more particularly, on one side of the base plate. To the ink jet recording head thus manufactured, the is supplied into the liquid passage through the liquid chamber constituted by the recess 201 of the top plate from the ink supply port 204. For the ink ejection, an electric signal is applied to an ejection energy generating element disposed corresponding to an associated passage, so that the ink is heated by the thermal energy produced by the ejection energy generating element. By the heat, film boiling is produced in the ink with the result of creation of a bubble to provide a pressure to eject the ink through the ejection outlet (orifice) 203.

In this embodiment, 10 heater boards are used to provide 1280 ejection energy generating elements in the long head. However, the number of heater boards is not limiting, and it may be two or more.

With this structure, the ink supply system is simplified, downsized and in expensive, as compared with a plurality of small heads each having the top plate mounted on each heater board. Also, the manufacturing yield can be increased. In addition, since a plurality of heater boards are disposed on one side of the base plate, the electric wiring can be simplified. In addition, a long top plate covering an array of energy generating elements provided by the plurality of heater boards, is mounted on the base member, and therefore, the directions of the individual passages are uniform as contrasted to the case that small heads are arranged. Particularly when one top plate is used, the directions of all of the passages are aligned by one aligning operation, so that long head free of printing deviation, can be easily provided.

Thus, the ink is ejected through an integral orifice plate, and the passages are also integral, so that the ejection and ejection directions are uniform, as if it is a single long head.

When a small head are used, there is a necessity for effecting sealing for each small head. However, in this embodiment, the since the top plate covers a plurality of heater boards, the number of sealings is small.

Particularly when, only one top plate is used, one sealing is enough a plurality of top plates each covering a plurality of heater boards not all of the heater boards, may be used in the present invention, but use of the single top plate is most desirable.

In this embodiment, the top plate is provided with orifices (ejection holes) for ejecting the ink. This is preferable because the ink ejecting directions are determined by the top plate so that the high speed and high quality head can be most easily provided. Even if the top plate is not provided with orifices, that is, even if the orifices are provided by the connection between the heater board and the grooved top plate, the directions of the ink passages can be aligned using the long top plate in this invention, and therefore, the stability of the ink ejection direction can be assured, which leads to satisfactory image printing. However, the top plate integrally having the orifices is better since the ejecting directions are aligned more accurately, and since the manufacturing steps are simplified.

In this embodiment, the gap between the adjacent heater boards is sealed by a sealant. The detailed description will be made as to the sealing for the gap. When a plurality of heater boards are mounted on a support, the heater boards may be abutted to each other, but with this arrangement, the following problems arise. The flatness of the abutment surfaces of the heater boards have to be very high. If foreign matter is sandwiched therebetween, the positional accuracy is not enough. The heater board may be damaged by the abutment. The heater board may be deviated by thermal expansion. In order to prevent this, in this invention, the heater boards are arranged with gap therebetween. However, in such a case, the following problems arise.

(1) By the provision of the gap, the ink is easily leaked at the bottom of the passage at the end portions of the unit, and upon the ink ejection, the ink enters the gap with the result of crosstalk at the end portions.

(2) The ink enters the gap between the protection film or the like resulted from cutting or the like of the unit end with the result of electric corrosion.

Figure 6:
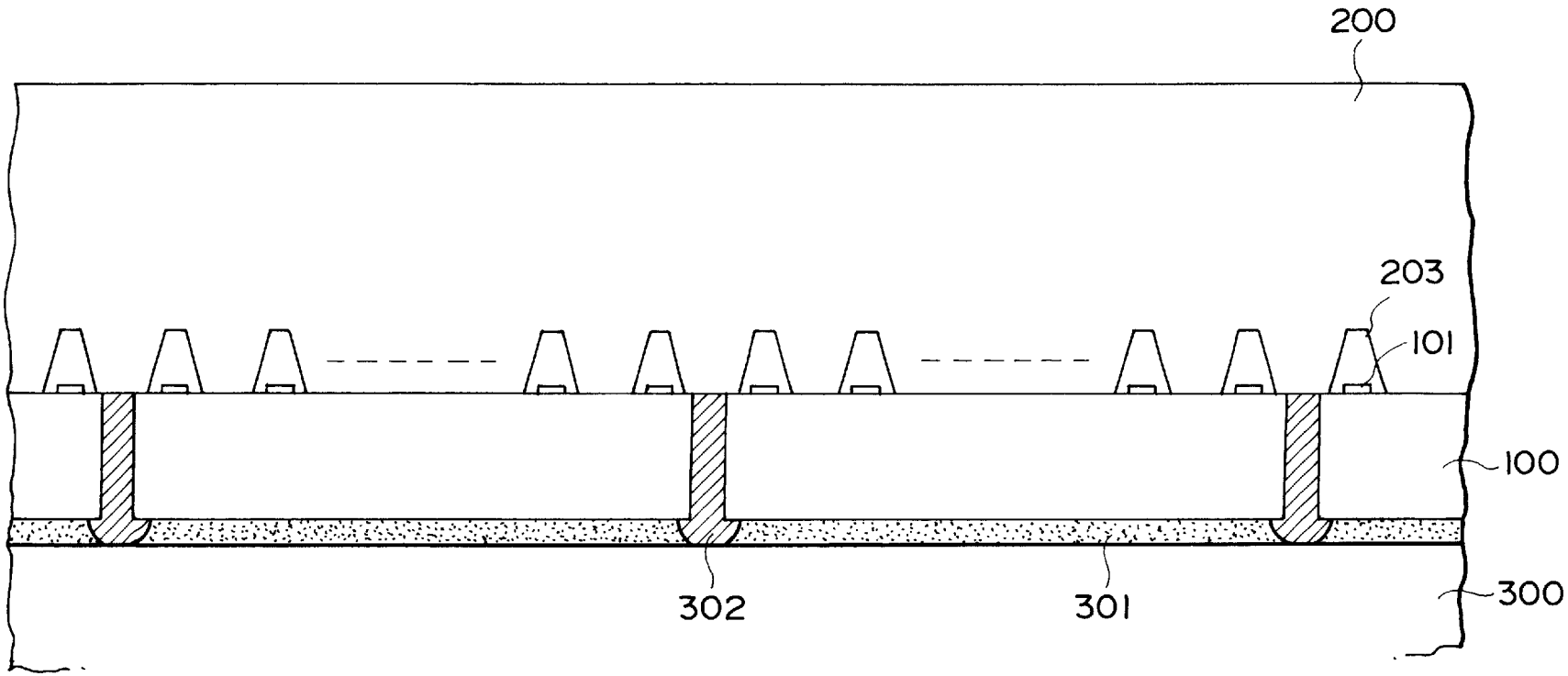
FIG. 6 is a schematic view illustrating a positional relationship between a heater board and a top plate of an ink jet recording head according to the present invention.

Such liabilities arise. In view of this, in this embodiment, the gap is sealed by a resin material (FIGS. 6 and 7).

Figure 7:
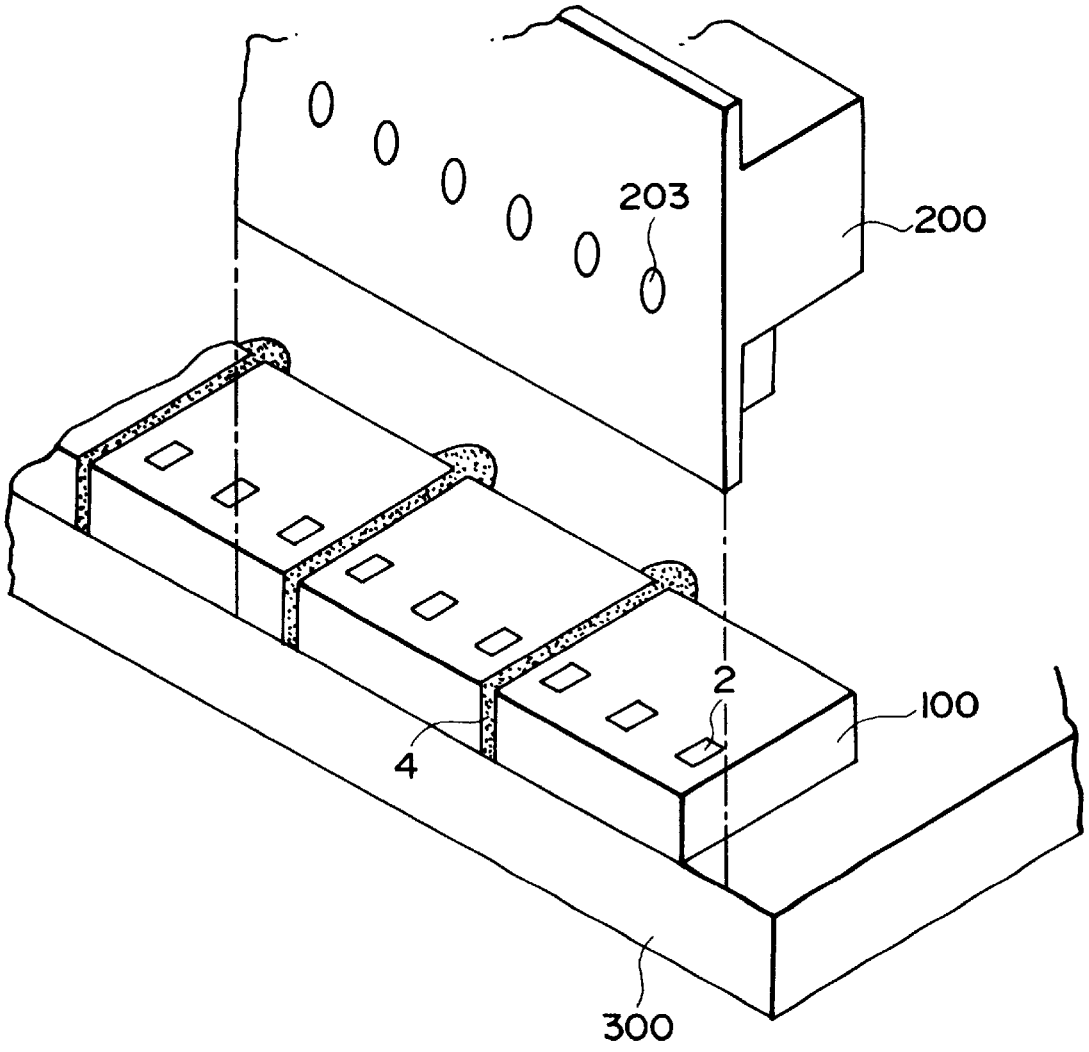
FIG. 7 is an exploded perspective view of an ink jet recording head according to the present invention.
Figure 8:
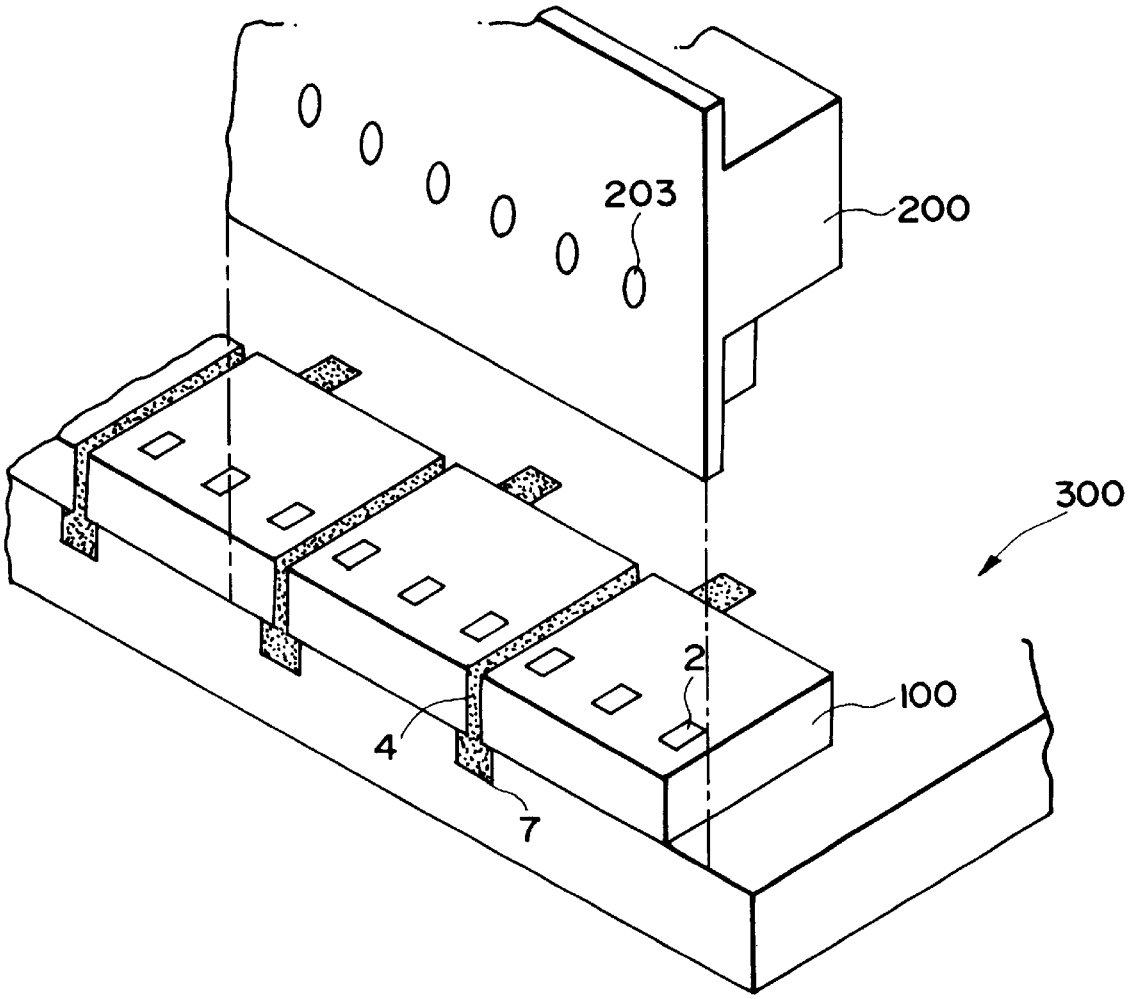
FIG. 8 is an exploded perspective view of an ink jet recording head according to an embodiment of the present invention.

FIG. 8 shows such an ink jet recording head. In this Figure, the same reference numerals as in FIG. 7 are assigned to the corresponding elements. In this example, the base plate 300 is provided with a guiding groove 7 in order to control the flowability of the silicone resin material curable at normal temperature to fill the gap between adjacent heater boards. The guiding groove preferably has a rectangular, square, V cross-section or the like.

The description will be made as to the manufacturing method of the ink jet recording head shown in FIGS. 7 and 8.

In this embodiment, in order to provide a 360 dpi ink jet recording head for a line printer for A4 size. 24 boards each having patterned 128 energy generating elements 12 at 360 dpi, are disposed on aluminum base plate 3, as shown in FIG. 7.

They are correctly aligned using image processing such that the interval between adjacent energy generating elements of adjacent heater boards, are equal to the interval between the adjacent energy generating element within one heater board. The design gap between adjacent heater boards is 16 $\mu$m, but actually it is 2–16 $\mu$m because of the cutting accuracy and the positioning accuracy of the heater boards.

Immediately before arranging the heater boards on the support 300, a heat curing dibon bonding layer of a thickness of several microns is provided through screen printing on the support 300. The silicone substrates of the heater boards have been the ones cut out of one and the same silicone wafer for the purpose of alignment with the accuracy of the height of ±1 $\mu$m.

After the bonding layer is cured, the gap between the heater boards is filled with silicone sealant (TSE 399, available from Toshiba Silicone Kabushiki Kaisha, Japan) by dropping 0.3 g to the rear side of the gap between the heater boards and using capillary force. In this manner, a first substrate is provided in this embodiment.

Then, the heater board and a PCB board already bonded on the base plate 300 are electrically connected through wire bonding. Thereafter, it is connected with a top plate 200 having grooves for constituting ink passages and having an ink ejection outlets, such that the grooves are in alignment with the associated energy generating elements, respectively. Then, the sealing and the connection with the ink container are carried out, and the ink jet recording head is manufactured. When the actual printing operations are carried out using the thus produced ink jet recording head, satisfactory high quality printing was provided without missing part. Practically, there has not been any problems of ejection power leakage (crosstalk) of the ink at the end nozzles of each of the heater boards.

The description will be made as to the manufacturing method for the ink jet head of FIG. 8. The heater boards are disposed on the base plate 300 in the similar manner as in the foregoing embodiment with the exception that guiding grooves 7 shown in FIG. 8 are formed on the base plate 300 with the cross-section of square (0.5×0.5 mm).

With this guiding groove, the silicone sealant (TSE 399) used for the sealing of the gap between the heater boards, first enters the gap between the heater boards, and then it enters the guiding groove.

In the method not using the guiding groove, the silicone normal temperature curing resin material is cured before it fills the gap between the heater boards, as the case may be.

According to the method of this embodiment, it never occurs, although 120 times were carried out. The reason for this considered as being that the sealant in the guiding groove is always supplied to the gap between the heater boards.

Therefore, the advantageous effects of the guiding groove is very significant. The printing quality is high enough by this line type printer ink jet recording head (A4 size).

In this embodiment, even if there is a step formed at the connecting portion between the adjacent heater boards, the abutment portion is made smoother by the sealant, and therefore, better connection is accomplished.

As the sealant, the known material used in the ink jet recording apparatus manufacturing or a semiconductor manufacturing, but it is preferably good in the electric insulation and elasticity and durability against ink. Examples of such materials, include silicone sealant or urethane sealant.

When the gap between the adjacent heater board is very small, the same sealant material is used for fixing the heater board and for between the adjacent heater boards.

In this embodiment, the description will be made as to the structure for covering the gap between the heater boards by a wall of the top plate.

When a plurality of substrates are successively placed on the same surface of a support in the manufacturing of the recording head, it is desirable that a small gap is provided between adjacent heater boards, as described hereinbefore in consideration of the positional accuracy of the substrates on the support, and the difference in the thermal expansion between the support and the substrate or heater board.

Figure 9:
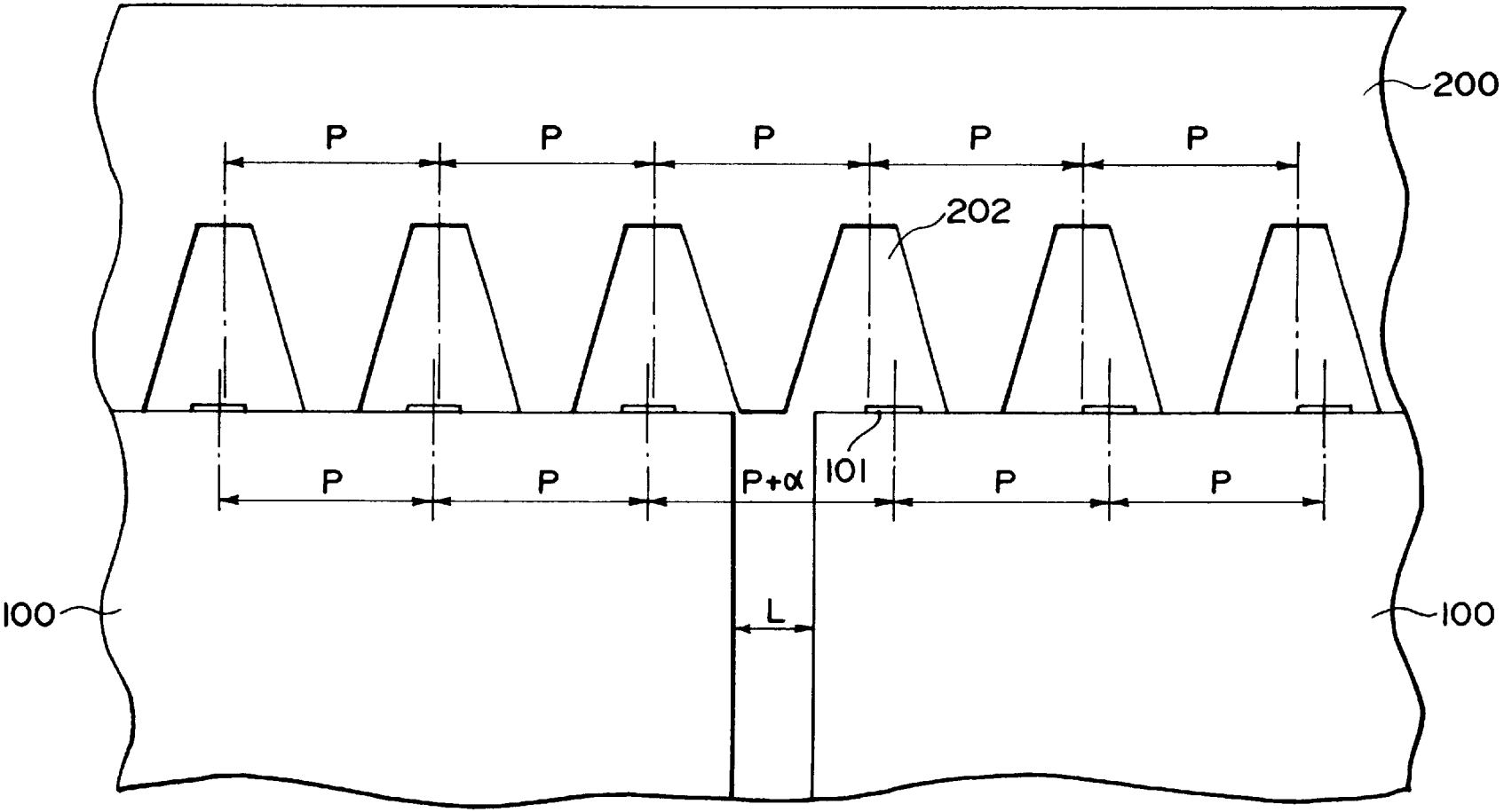
FIG. 9 PRIOR ART
FIG. 9 illustrates an ink jet recording head of background art.

FIG. 9 is a sectional view of a head constituted by connecting a top plate or member having grooves constituting the passages to the plurality of the heater boards on the support. Between the heater boards, there are gaps L, which are not uniform depending on the positional accuracies of the heater boards. If this occurs or if deviation occurs in the mounting position of the grooved member to the heater board, the passage opens to the gap, as indicated by a reference numeral 202, with the result of liability of release of the pressure to be used to eject the ink. The ejection performance of the ink through the ejection outlet adjacent the gap may be different from that of another gap. This may results in non-uniformity or unintended stripes in the recorded image.

In this embodiment, the gap is covered by a wall for constituting the passage.

Figure 10:
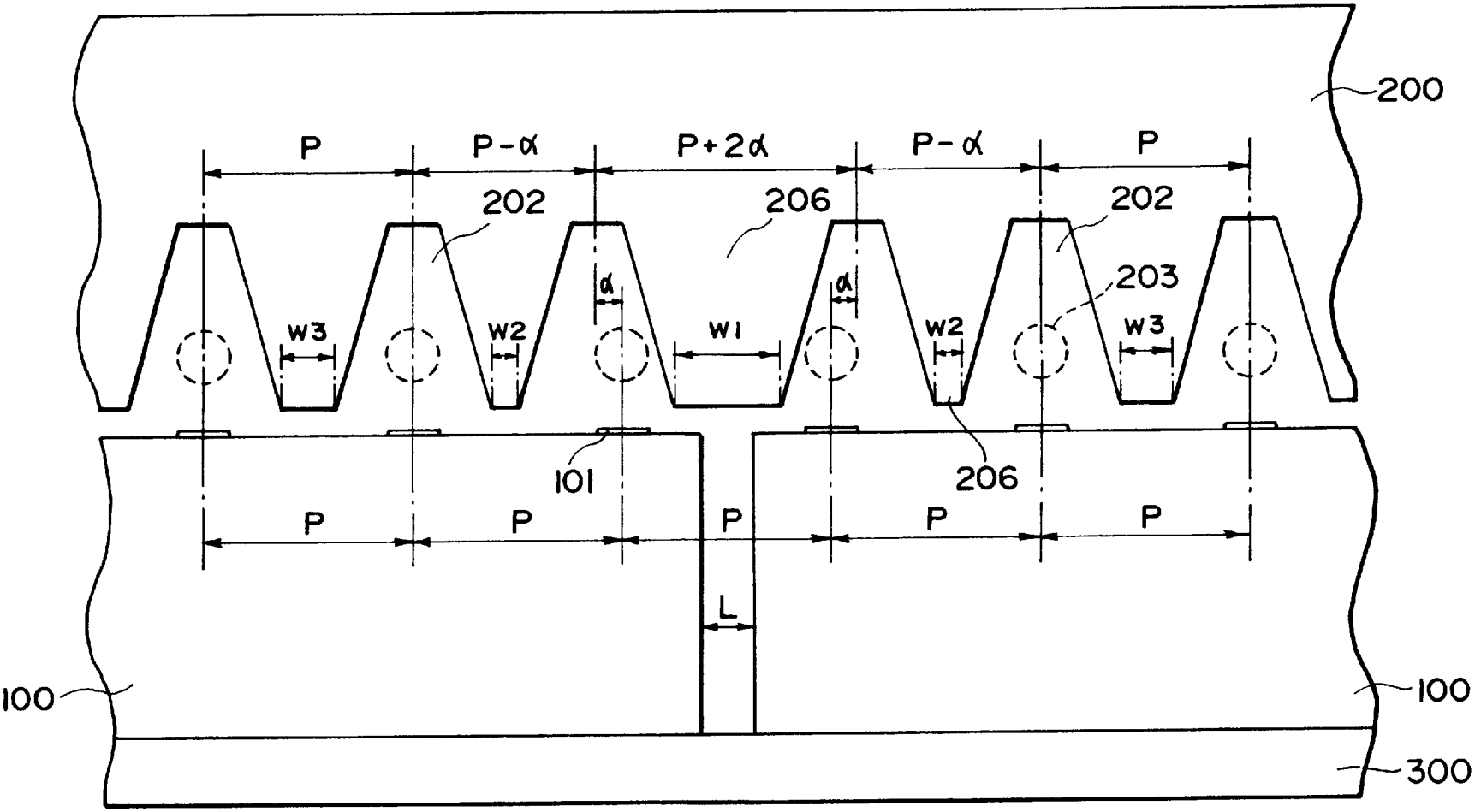
FIG. 10 illustrates a positional relationship between the heater board and a top plate.

FIG. 10 shows a relationship between the gaps and the top plate 200 in this embodiment.

The dimensional accuracy of the heater board is ±2 μm relative to its absolute position, and the dimensional accuracy of the length of the heater board per se is 1±5 μm. These values are from the apparatuses of highest performance available at present. It is difficult to increase the accuracy more at present. Therefore, the tolerance is ±2+±5×2=±14. In this embodiment, L=14 in view of this tolerance and the gap L=14±14 μm. At this time, the adjacent heater board end elements 101 are disposed with an interval of P=70.5 μm with the gap therebetween to provide the same interval within the heater board. On the other hand, the top plate 200 faced to the base member has grooves 202 for constituting the passages with the interval P=70.5 μm. A wall thickness 206 providing the discrete passages 202 (a width at the contact surface with the base member in this embodiment) W3 is 20 μm. However, the width of the wall 206 corresponding to the gap between the heater boards is expanded to W1=36 μm. In other words, the passages 202 sandwiching the gap is deviated by α (α=8 μm). By doing so, the wall thickness at the both sides W2=12 μm which is smaller. Therefore, the intervals between passages 202 is P, P−α, P+2α, P−α and P, from the left side. As indicated by broken line, the orifices 203 are arranged with an interval or pitch P corresponding to the interval between the ejection energy generating elements.

By using the above-described structure described hereinbefore for the wall of the top plate, it is possible to cover the gap by the wall thickness W1 =36 μm which is larger than the gap L which is 28 μm (L=14+14) at the maximum as a result of manufacturing tolerance. Actually, there is an error when the top plate is aligned with the heater boards (usually ±4 μm approx.), the gap can be covered thereby sufficiently even if this error is included. With this structure, even if there is a gap between adjacent heater boards, the gap can be covered to prevent the liability of leakage of the ejection pressure for ejecting the ink.

A further embodiment of the present invention will be described.

In the foregoing embodiments, the material of the top plate 200 is resin material, and the material of the base plate supporting the heater board is metal such as stainless steel or the like.

Figure 11:
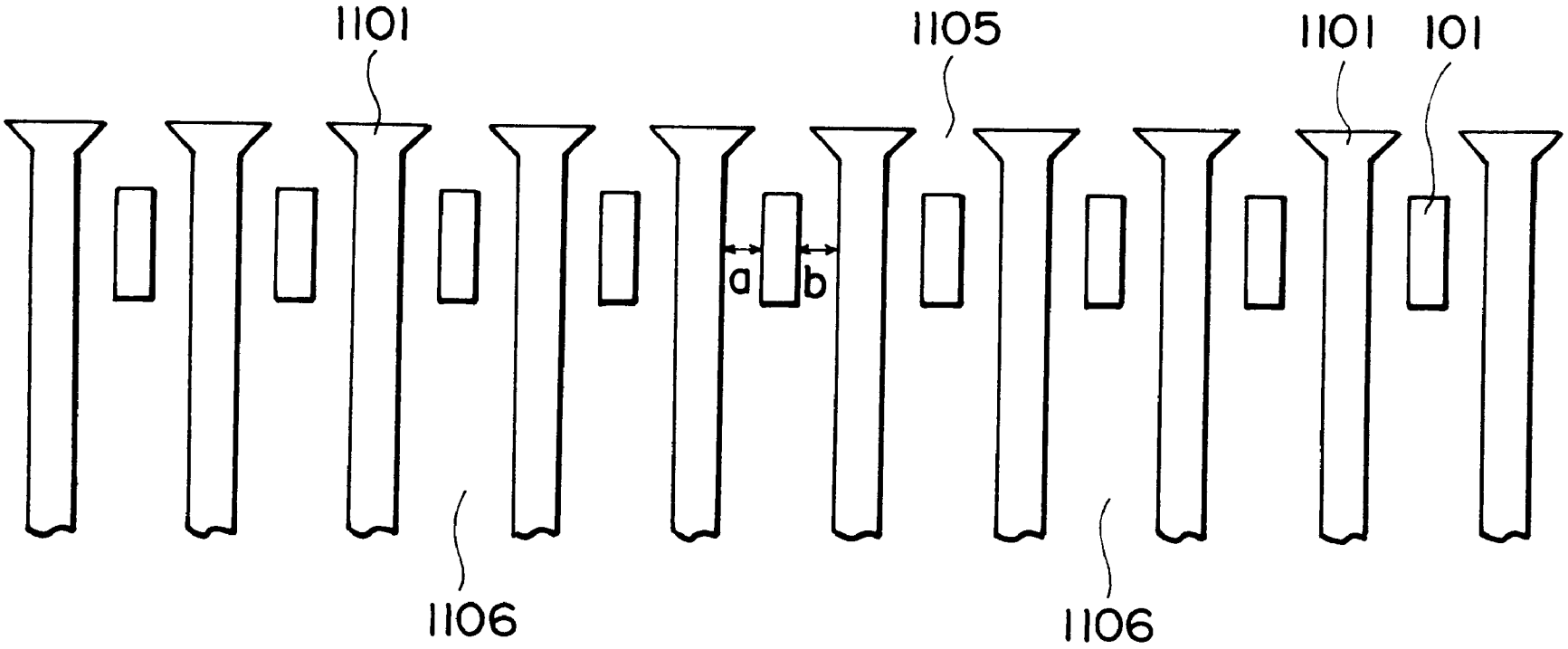
FIG. 11 is a schematic view of a structure of a recording head of the background art.

In FIG. 11, there is shown a positional relationship between passages 106 of the ink jet head and ejection energy generating elements 101, wherein the ejection energy generating elements are substantially at the centers of the respective passages (a nearly equal b). Reference numeral 1105 designates an ejection outlet, and a reference numeral 1101 is a wall for constituting the passage. When a long head having 3008 nozzles in such an ink jet head is used to effect the recording, or when the recording is effected under very high temperature ambience or under a very low temperature ambience, there is a liability that, as shown schematically in FIG. 12, the positional relationship between the passage and the ejection energy generating element may be deviated due to the difference between the thermal expansion coefficients of the base plate and the top plate at the end of the heads.

The thermal expansion coefficient of the resin material constituting the top plate is approx. $1\times10^{-5}$–$1\times10^{-4}$ approx. The following description will be made, taking polysulfone (thermal expansion coefficient: $56\times10^{-6}$) as an example. When silicon is used for the heater board 100, the thermal expansion coefficient is $2.4\times10^{-6}$, and the thermal expansion coefficient of the stainless steel used as the base plate 300 supporting the heater boards 100 is $17.3\times10^{-6}$. Even if the recording head is correctly assembled under the temperature about 25° C., the temperature of the recording head may probably increase to 60° C. by the operation thereof.

Assuming that the long head has 3008 nozzles, the following deviation occurs:

(number of nozzles)×(pitch)×(temperature difference)×(difference in thermal expansion coefficients)=3008×0.0705×(60−25)×($56\times10^{-6}$−$17.3\times10^{-6}$)=0.287 mm This corresponds to 4 nozzles, and therefore, there is a possibility that the head becomes non-usable.

Therefore, when the number of ejection outlets is very large, or when the recording head is used under special temperature conditions, the countermeasure is desirably taken against the thermal expansion.

FIG. 13 shows such an embodiment, wherein the grooved top plate is schematically shown, wherein (a) is a top plan view, (b) is a front view, (c) is a bottom plan view and (d) is a sectional view.

The top plate 200, as shown in FIG. 13, (d) which is X—X cross-section, a supporting member 205 capable of adjusting the thermal expansion coefficient of the top plate 200 is contained in the resin material constituting the groove portion of the top plate 200. Here, the material of the supporting member 205 has the equivalent thermal expansion coefficient to that of the base plate 300. In this embodiment, it is of stainless steel as in the base plate. The surface of the supporting member 205 has been subjected to a surface treatment such as blast process, knurling process, by which the contact with the resin part of the top plat 200 is further improved. With this structure, the thermal expansion coefficient of the top plate 200 is closer to that of the stainless steel. By doing so, the top plate 200 of the head and the base plate 300 thereof have the thermal expansion coefficient equivalent to each other, and therefore, no significant deviation occurs between the top plate 200 and the base plate.

There is also a thermal expansion difference between the single heater board 100 and the top plate, but the deviation is so small that the ejection performance is not influenced.

In this embodiment, the supporting member 205 is within the resin material, but it is not necessarily completely contained therein, but a part (opposite ends, for example) may be exposed to the outside.

In this embodiment, the contactness of the resin material is improved by machining the surface of the supporting member 205, but if the contact between the supporting member and the resin part is good enough, this not inevitable. However, the top plate has been manufactured by injection molding while the supporting member is therein, but the sufficient contactness is not always assured by such an injection molding, and therefore, the surface roughness is preferably provided on the surface of the supporting member 205 to improve the contactness.

To provide pits and projections for the purpose of providing the surface roughness, grooves having approx. 1 mm may be directly machined, or when the core material is machined, the trace of the machining is deliberately retained, or the surface is roughened by sandblasting. In any case, biting occurs between the core material and the resin material so that the thermal expansion of the core material is closer to the resin material.

The improvement of the contactness between the resin material and the supporting member, may be accomplished by the provision of the surface roughness, or by applying a coupling material such as silane coupling material or the like on the supporting surface. However, in consideration of the influence to the ink, the formation of the pits and projections as described above is preferable.

In order to provide sufficient response of the thermal expansion of the resin material to that of the supporting member, the thickness of the resin material is preferably 2 mm or lower or further preferably 1.5 mm or lower from the supporting material.

In the foregoing embodiment, the stainless steel as in the base plate is used since it has the same thermal expansion coefficient as the base plate. The description will be made as to the example of the state of ejection performance of the liquid relating to the difference of the thermal expansion coefficient between the base plate and the supporting member.

Here, the material of aluminum and stainless steel are changed for the base plate and the supporting member in the experiments. The base plate has to carry the heater boards, and has to be subjected to various machining for the purpose of coupling with the main assembly, and therefore, it is desired to have high machinability and heat radiation property to quickly release the heat coming from the heater board. In view of the above, the aluminum is used. As for the supporting material, stainless steel is used in consideration of the contactness with the polysulfone resin and the mechanical strength.

In Table 1, there are given the materials tested, the thermal expansion coefficients, calculated deviations between the nozzles and the heaters at 30° C., 40° C., 50° C. and 60° C., and evaluations of the printing at 30° C., 40° C. and 50° C. The calculation of the deviation is based on 360 dpi (=70.5 μm) between first nozzle and the last nozzle of 3008 nozzles (=3008×70.5 μm×(temperature −25° C.)×(thermal expansion coefficient difference)×(½)).

The temperature when the head is assembled is 25°C., and the temperature difference is based on this temperature.

The temperature of the recording nozzle is usually controlled to 35° C.–40° C. However, the printing rate is high, when a long term printing is carried out, or when the ambient temperature increases, the temperature of the head in some cases reached 50° C. However, usually the printing operation is stopped before the temperature reaches 60° C. Therefore, the printing at this temperature is not practical. However, the ambience in which the head is kept is 60° C. at the highest, and the data at this temperature are also given.

TABLE 1

| | Base plate | | | | | |
|---|---|---|---|---|---|---|
| Support | Aluminum 5056 (Al drawn) $24.3 \times 10^{-6}$ (1/° C.) | | | Aluminum 4032 (Al forged) $19.9 \times 10^{-6}$ (1/° C.) | | |
| | Diff. $7.0 \times 10^{-6}$ (1/° C.) | | Print quality | Diff. $2.6 \times 10^{-6}$ (1/° C.) | | Print quality |
| Stainless | 60° C. | 26 μm | — | 60° C. | 10 μm | — |
| SUS304 | 50° C. | 19 μm | G | 50° C. | 7 μm | E |
| $17.3 \times 10^{-6}$ | 40° C. | 11 μm | G | 40° C. | 4 μm | E |
| | 30° C. | 4 μm | E | 30° C. | 1 μm | E |
| | Diff. $14.0 \times 10^{-6}$ | | Print quality | Diff. $9.6 \times 10^{-6}$ | | Print quality |
| Stainless | 60° C. | 52 μm | — | 60° C. | 36 μm | — |
| SUS430 | 50° C. | 37 μm | NG | 50° C. | 25 μm | F |
| $10.3 \times 10^{-6}$ | 40° C. | 22 μm | F | 40° C. | 15 μm | G |
| | 30° C. | 7 μm | E | 30° C. | 5 μm | E |

E: No difference is observed in the print.

G: Hardly any difference is observed, but the shot point accuracy is deteriorated as a result of measurement.

F: Ejecting direction deviation is recognized in the print.

NG: Ejection deflection is remarkable, and with ejection failure sometimes.

The problems are all resulted from the positional relationship between the nozzle and heater. In this experiments, the nozzle pitch (heater pitch) is 70.5 mm, and the nozzle width is 50 μm. If the deviation between the groove of the top plate and the heater position is not more than 10 μm, the ejection performance is not at all influenced. If it is larger and not larger than 20 μm, slight deterioration is observed but practically not a problem.

From the foregoing, it has been found that there arises practically no problem if the thermal expansion coefficient difference (25° C.–50° C.) is less than $10 \times 10^{-6}$ between the base plate and the supporting member. Further preferably, it is not larger than $2.6\times10^{-6}$.

Here, as the materials of the base plate and the supporting member, aluminum, stainless steel or the like, but this is not limiting, and on the basis of the performance desired for the head, the base plate may be of stainless steel, aluminum, ceramic material, resin material or the like, and the supporting material may be of stainless steel, aluminum, ceramic material, glass material or the like, if they are equivalent within the range above-described.

However, as described above, when the considerations are paid to the machinability, thermal conductivity and the contact property with the resin material, the base plate is of aluminum material, and the supporting material is stainless steel materials. Using the above-described structure, even if the temperature of the head itself increases, there occurs no significant deviation between the position of the heater on the heater board and the groove of the top plate, and therefore, satisfactory recording operation is possible with stability.

Figure 14:
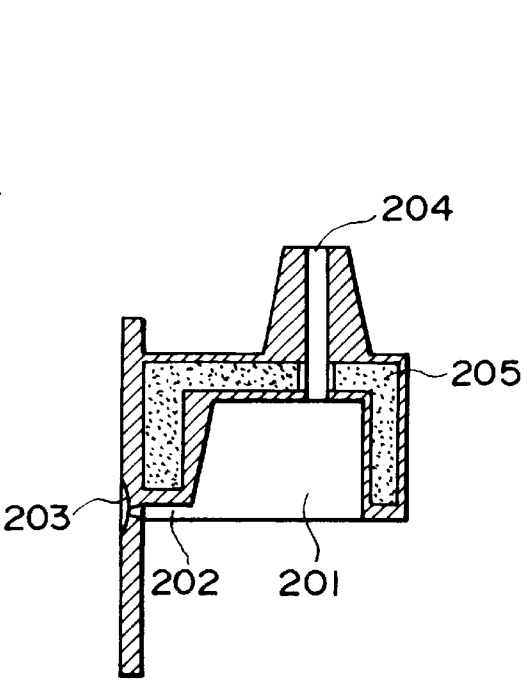
FIG. 14 is a schematic view illustrating a top plate used in this invention.

A further embodiment will be described. FIG. 14 shows a further embodiment of the top plate 200. It shows only X—X section of FIG. 13. The same reference numerals 201–205 are assigned for the same elements. In FIG. 14, the supporting member 205 occupies most part of the inside of the top plate, having a channel-like cross-section. By doing so, the mechanical rigidity of the supporting member 206 is significantly increased, the curving due to the temperature coefficient difference between the resin part and the supporting member can be avoided.

As compared with the supporting member shown in FIG. 13, the thermal expansion coefficient of the liquid chamber portion can be adjusted in addition to the liquid passage portions, and therefore, the deformation of the liquid chamber is small, so that the recording head is durable in long term use.

FIG. 15 shows a further embodiment of the top plate. The supporting member 205 in FIG. 15 is in the form of a pipe, and the opposite end portions thereof are projected beyond the top plate. The pipe is provided with a slit to permit fluid communication between the inside of the pipe and the liquid chamber 201. By doing so, the pipe of the supporting member 205 may be used as the liquid chamber. In addition, the end portions thereof are usable as ink supply joint. The slit 206 may be replaced with perforations having proper intervals. By doing so, the mechanical rigidity of the supporting member 205 can be significantly increased. In order to use the supporting member as the ink supply pipe, the supporting member is required to have the rigidity as the supporting member and anti-corrosion property against ink. Recently, acidic alkaline ink is widely used, and therefore, it is required to have durability against the material. Preferably, the cost is low. Examples of such materials include aluminum alloy or stainless steel. Examples of aluminum alloys, include A505, A506, A6061, A6063 or the like which have anti-corrosion property. Examples of stainless steels include SUS 303, 304, 430 or 420. From the standpoint of machinability and cost, aluminum alloy is preferable, but stainless steel is preferable from the durability against ink.

In this embodiment, one side of the supporting member is effective to constitute a part of the common liquid chamber. By this structure, the ink can be directly supplied to the liquid chamber, and therefore, satisfactory ink supply can be accomplished with a small number of parts.

Using the above-described structure, a long ink jet recording head with very small number of parts and with uniform ejection performance can be easily manufactured. As contrasted to the case of using an integral substrate, it is possible to use only satisfactory substrates, and therefore, high yield, and therefore, low cost can be accomplished.

In this embodiment, since the grooved member (top plate) contains a supporting member having an equivalent thermal expansion coefficient to that of the base plate, it can be avoided that the deviation occurs between the ejection energy generating element and the nozzle positions due to the thermal expansion difference upon temperature rise as a result of the external ambience change or the operation of the recording head, and therefore, high quality printing can be assured at any temperature.

By the improvement of the contact property by the mechanical pits and projections on the surface of the supporting member, the proper contact between the resin and the supporting material is assured, so that the top plate capable of following the thermal expansion of the supporting member at any temperature, can be easily provided.

By using a pipe-like supporting member, it can be used as also an ink supply pipe, thus the number of parts can be reduced, so that the cost of the head can be further reduced.

In the foregoing embodiments, the description has been made as to the head in which the ink is ejected in a direction along the surface of the heater board, that is, the ejection outlet is at the end of the passage, but the present invention is applicable to a head in which the ink is ejected substantially perpendicular to the surface of the heater board.

Figure 16:
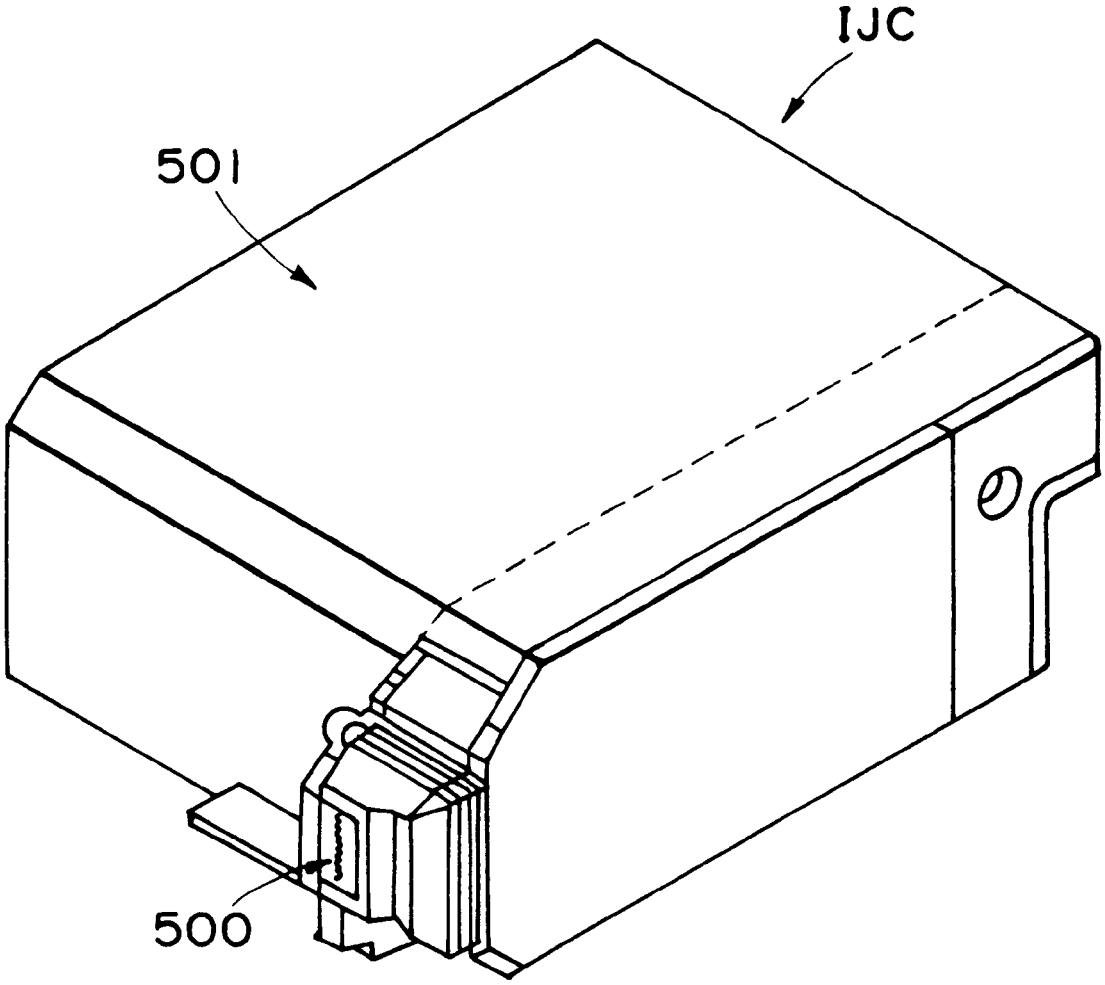
FIG. 16 PRIOR ART
FIG. 16 schematically illustrates a head cartridge according to an embodiment of the present invention.

FIG. 16, a further embodiment will be described. In the foregoing, a plurality of heater boards each having an ejection energy generating element are disposed on the base plate of glass, silicon, ceramic material, metal or the like with high accuracy. It is coupled with a top plate having grooves for constituting the liquid passage and orifice. FIG. 16 shows an ink jet cartridge using such an ink jet head. The ink jet head cartridge comprises an ink jet head 500 and an ink container 501 for containing ink to be supplied to the ink jet recording head, which is integral or separable relative to the ink jet head 500. With this structure, an ink jet cartridge having the above-described advantageous effects can be provided. The ink is supplied into the ink container. When the ink refilled is contained, the service life of the head cartridge is extended, so that the running cost can be reduced.

Figure 12:
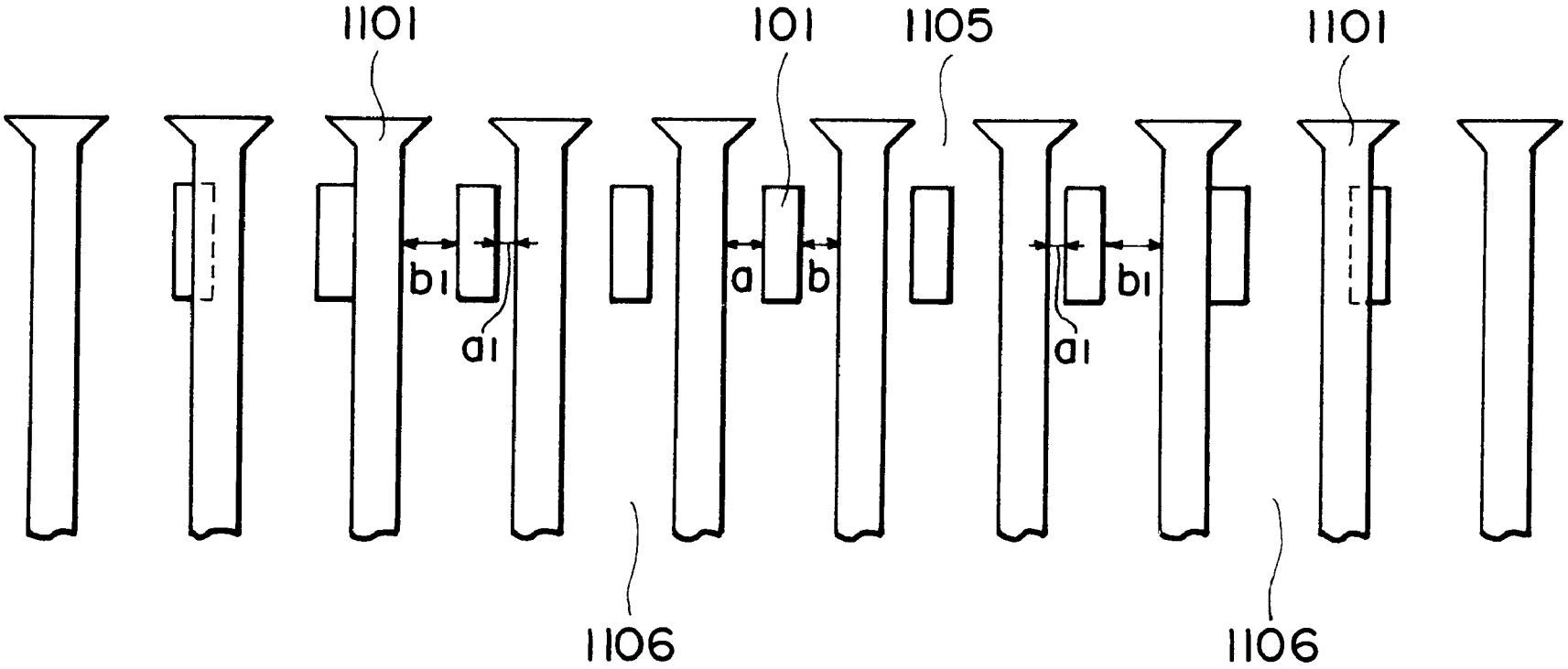
FIG. 12 illustrates thermal behavior in the head of the background art.

Referring to FIG. 12, an ink jet apparatus using the above-described ink jet head will be described.

Figure 17:
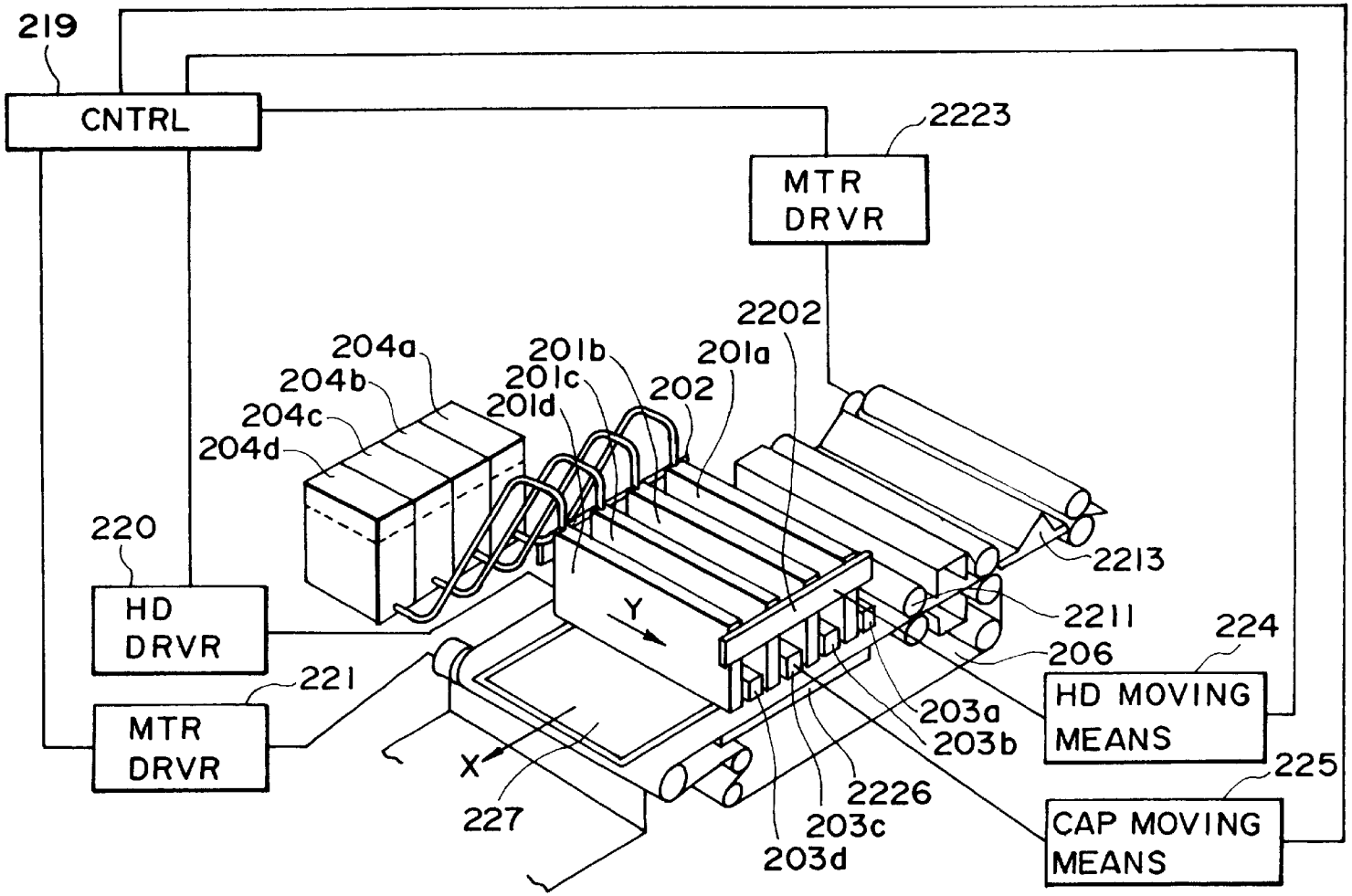
FIG. 17 PRIOR ART
FIG. 17 illustrates a recording apparatus according to the present invention.

FIG. 17 shows an example of an ink jet recording apparatus incorporating the ink jet recording head according to an embodiment of the present invention, although owing to the scale of the drawing, that invention may not be visible.

As shown in FIG. 17, the ink jet recording apparatus is provided with line-type heads 201*a*–201*d*. The line type heads 201*a*–201*d*, are fixed to be extended in parallel with each other with a predetermined gap in X direction by a holder 202. In the bottom surface of each of the recording heads 3456 ejection outlets are provided directed downward and arranged in one line at the density of 16 ejection outlets per 1 mm. This permits the recording on the width of 218 mm. Each of the recording heads is a type of using thermal energy, and the ejection is controlled by a head driver 220 (driving signal supplying means).

A head unit is constituted by heads and a holder 202. The head unit is movable up and down by head moving means 224.

Below the heads 201*a*–201*d*, head cap 203*a*–203*d* are disposed adjacent to each other and corresponding to the associated heads 201*a*–201*d*. In the head caps 203*a*–203*d*, ink absorbing materials such as sponge material are provided.

The caps 203*a*–203*d* are fixed by an unshown holder, and the capping unit includes the holder and the caps 203*a* and 203*d*. The cap unit is movable in X direction by a cap moving means 225. Each of the recording heads 201*a*–201*d*, is supplied with either of cyan, magenta, yellow and black color ink through the associated ink supply tube 205*a*–205*d* from the associated ink container 204*a*–204*d* to permit color recording.

The ink supply uses capillary force of the head ejection outlet, and the liquid surface level in each of the ink containers 204*a*–204*d* is lower than a predetermined amount than the ejection outlet position.

The apparatus is provided with an electrically chargeable seamless belt 204 for carrying a recording sheet 227 (recording material).

The belt is extended through a predetermined path around a driving roller 207, idler rollers 209, 209*a* and a tension roller 210. The belt is rotated by a belt driving motor 208 connected to the driving roller 207 and driven by a motor driver 221.

The belt 206 travels in the direction X immediately below the ejection outlets of the heads 201*a*–201*d*. Here, the downward deviation is suppressed by the fixing member 226.

Designated by a reference numeral 217 is a cleaning unit for removing paper dust or the like from the surface of the belt 202.

The recording apparatus is usable for textile printing, a textile printing system including pre-process including fixing, or post-processing, and a copying machine having a reading device.

Figure 18:
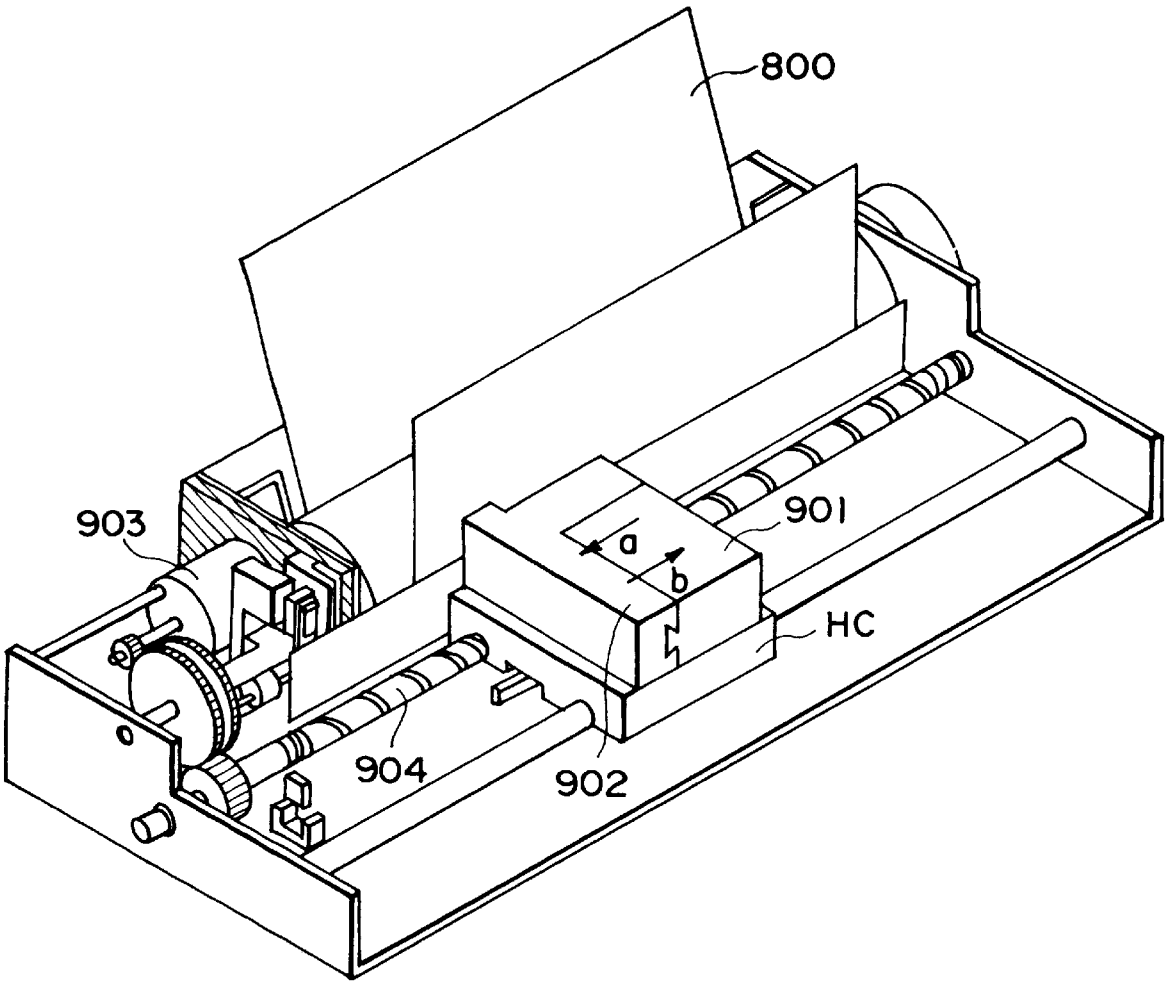
FIG. 18 PRIOR ART
FIG. 18 illustrates a recording apparatus according to the present invention.

FIG. 18 shows a recording apparatus having a recording head with at least two heater boards, in accordance with this invention; owing to the scale of the drawing, that invention may not be visible. In the recording apparatus shown in FIG. 18, an ink jet recording head cartridge having an ink container 901 and a recording head 902 detachably mountable therefrom carried on a carriage AC, and comprises a motor 903 as a driving source for driving feeding rollers or the like for feeding the recording material 800, a carriage 904 for transmitting the driving force from the driving source to the carriage. It further comprises a signal supplying means for supplying signal for ejecting the ink to the ink jet recording head.

Figure 19:
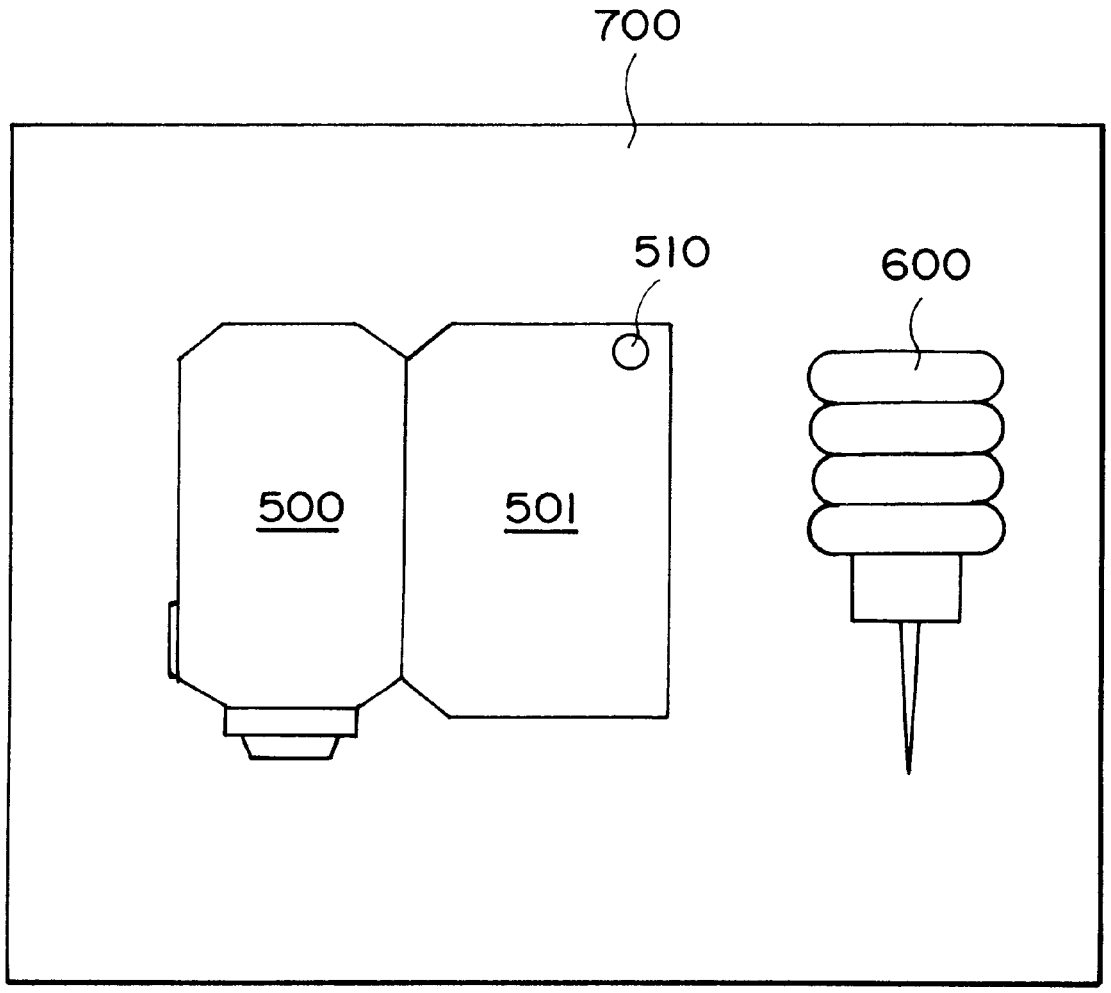
FIG. 19 illustrates an ink jet head kit according to an embodiment of the present invention.

FIG. 19 schematically shows an ink jet head kit 700 of this invention. It comprises an ink jet head 500, an ink container 501 integral or separable relative to the head 500, and ink filling means 600 for filling the ink into the ink container. Using such an ink jet head kit, the running cost of the ink jet head can be reduced. The description will be made as to the ink filling method using the ink jet head kit.

A part of the ink filling means is inserted through an air bent 510 of the ink container, a connecting portion relative to the head and a hole formed in the ink container from which the ink is used up, and the ink is supplied into the ink container. Through such a filling method, the ink can be easily filled, so that the running cost of the head cartridge can be reduced.

While the invention has been described with reference to the structures disclosed herein, it is not confined to the details set forth and this application is intended to cover such modifications or changes as may come within the purposes of the improvements or the scope of the following claims.

What is claimed is:

1. A liquid ejection recording head for ejecting a liquid, comprising:

a plurality of element substrates each having a plurality of ejection energy generating elements for ejecting the liquid;

a base plate for supporting the plurality of element substrates on one surface thereof in an array with at least one gap therebetween;

a grooved member having a length corresponding to a length of the array and having passages corresponding to the ejection energy generating elements of the plurality of element substrates, wherein a plurality of passage walls constituting said passages and disposed between said passages include the passage wall covering the gap between said element substrates and the passage wall not covering the gap between said element substrates, and wherein a width of said passage wall covering the gap is different from a width of the passage wall not covering the gap.

2. A recording head according to claim 1, wherein said ejection energy generating element includes an electrothermal transducer.

3. A recording head according to claim 1, wherein the ejection energy generating elements are provided at substantially regular intervals over the plurality of element substrates.

4. A recording head according to claim 1, wherein said passage wall covering the gap has a width larger than a width of a passage wall not covering the gap.

5. A recording head according to claim 1, wherein the at least one gap is sealed with a resin material.

6. A recording head according to claim 5, wherein the resin material is curable under normal temperature.

7. A recording head according to claim 1, wherein said grooved member comprises a supporting member.

8. A recording head according to claim 7, wherein said supporting member has a thermal expansion coefficient equivalent to that of said base member.

9. A recording head according to claim 7, wherein said supporting member also functions as an ink supply tube for supplying the ink to said passages.

10. A recording head according to claim 4, wherein said grooved member has an array of ejection outlets for ejecting the ink out, in fluid communication with said passages, respectively.

11. A recording head according to claim 1, wherein the ink is ejected in a direction along a surface of said element substrate.

12. A recording head according to claim 1, wherein the ink is ejected in a direction non-parallel with said element substrate.

13. A recording head according to claim 1, wherein a plurality of the ejection outlets are provided corresponding to a width of a recording material for receiving the ink ejected by said ink jet recording head.

14. A recording head according to claim 1, wherein said liquid is an ink for recording.

15. A recording head according to claim 1, wherein the length is a length of an array of the energy generating elements contributable to ejection of the liquid, measured through the element substrates arranged in the array.

16. An ink jet head cartridge for effecting recording with ejection of ink comprising:

an ink ejection recording head for ejecting an ink comprising a plurality of element substrates each having a plurality of ejection energy generating elements for ejecting the ink; a base plate for supporting the plurality of element substrates on one surface thereof in an array with at least one gap therebetween; a grooved member having a length corresponding to a length of the array and having passages corresponding to the ejection energy generating elements of the plurality of element substrates, wherein a plurality of passage walls constituting said passages and disposed between said passages include the passage wall covering the gap between said element substrates and the passage wall not covering the gap between said element substrates, and wherein a width of said passage wall covering the gap is different from a width of said passage wall not covering the gap;

an ink container for retaining the ink to be supplied to said ink election recording head; and ink supply means for supplying the ink from said ink container to said ink ejection recording head.

17. A recording head cartridge according to claim 16, wherein said ejection energy generating element includes an electrothermal transducer.

18. A recording head cartridge according to claim 16, wherein said grooved member comprises a supporting member.

19. A recording head cartridge according to claim 18, wherein said supporting member also functions as an ink supply tube for supplying the ink to said passages.

20. A recording head cartridge according to claim 17, wherein the gap is covered with a passage wall of said grooved member.

21. A recording head cartridge according to claim 20, wherein said passage wall has a width larger than a width of a passage wall not covering the gap.

22. A recording head cartridge according to claim 16, wherein said recording head and said ink container are separable.

23. A recording head cartridge according to claim 16, wherein said ink container is filled with the ink.

24. A recording head cartridge according to claim 22, wherein said ink container is filled with the ink.

25. A recording head cartridge according to claim 23 or 24, wherein said ink container has been refilled with ink.

26. An ink jet recording apparatus for effecting recording with ejection of ink onto a recording material, comprising:

an ink ejection recording head for ejecting an ink comprising a plurality of element substrates each having a plurality of ejection energy generating elements for ejecting the ink; a base plate for supporting the plurality of element substrates on one surface thereof in an array with at least one gap therebetween; a grooved member having a length corresponding to a length of the array and having passages corresponding to the ejection energy generating elements of the plurality of element substrates, wherein a plurality of passage walls constituting said passages and disposed between said passages include the passage wall covering the gap between said element substrates and the passage wall not covering the gap between said element substrates, and wherein a width of said passage wall covering the gap is different from a width of said passage wall not covering the gap; and driving signal supplying means connected to said ejection energy generating elements for supplying a driving signal thereto.

27. An apparatus according to claim 26, wherein said ejection energy generating element includes an electrothermal transducer.

28. An apparatus according to claim 26, wherein said grooved member is provided with a recess for constituting a common liquid chamber for containing the ink to be supplied to said passages.

29. An apparatus according to claim 26, wherein said grooved member comprises a supporting member.

30. An apparatus according to claim 29, wherein said supporting member also functions as an ink supply tube for supplying the ink to said passages.

31. An apparatus according to claim 26, wherein the gap is covered with a passage wall of said grooved member.

32. An apparatus according to claim 26, wherein said passages are provided with a plurality of the ejection outlets corresponding to a width of the recording material for receiving the ink ejected by said ink jet recording head.

33. An apparatus according to claim 26, further comprising recording material feeding means for feeding a recording material.

34. An ink jet recording apparatus for effecting recording with ejection of ink, comprising:

an ink ejection recording head for ejecting an ink comprising a plurality of element substrates each having a plurality of ejection energy generating elements for ejecting the ink; a base plate for supporting the plurality of element substrates on one surface thereof in an array with at least one gap therebetween: a grooved member having a length corresponding to a length of the array and having passages corresponding to the ejection energy generating elements of the plurality of element substrates, wherein a plurality of passage walls constituting said passages and disposed between said passages include the passage wall covering the gap between said element substrates and the passage wall not covering the gap between said element substrates, and wherein a width of said passage wall covering the gap is different from a width of said passage wall not covering the gap; and recording material feeding means for feeding a recording material for receiving the ink ejected from said ink jet recording head.

35. An ink filling method for filling an ink into an ink container of an ink container of an ink jet head cartridge which effects recording with ejection of the ink, the ink jet head cartridge having an ink ejection recording head for ejecting the ink having a plurality of element substrates each having a plurality of ejection energy generating elements for ejecting the ink, a base plate for supporting the plurality of element substrates on one surface thereof in an array with at least one gap therebetween, a grooved member having a length corresponding to a length of the array and having passages corresponding to the ejection energy generating elements of the plurality of element substrates, wherein a plurality of passage walls constituting said passages and disposed between said passages include the passage wall covering the gap between said element substrates and the passage wall not covering the gap between said element substrates, and wherein a width of said passage wall covering the gap is different from a width of said passage wall not covering the gap; an ink container for retaining the ink to be supplied to said ink ejection recording head; and ink supply means for supplying the ink from said ink container to said ink ejection recording head; comprising the steps of:

preparing the ink container for the ink jet head cartridge; and filling the ink into the ink container.

36. An ink filling method as in claim 35, wherein the recording head and the ink container are separable.

* * * * *

UNITED STATES PATENT AND TRADEMARK OFFICE

CERTIFICATE OF CORRECTION

PATENT NO. : 5,933,163

DATED : August 3, 1999

INVENTOR(S) : YUTAKA KOIZUMI ET AL.

It is certified that error appears in the above-identified patent and that said Letters Patent is hereby corrected as shown below:

IN THE DRAWINGS

Figure 3A:
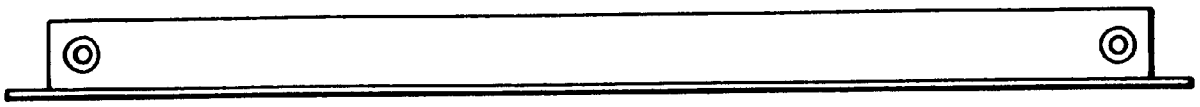
FIGS. 3*a*–3*d* are a schematic view illustrating a top plate of the ink jet recording head according to the embodiment of the present invention.
Figure 3B:
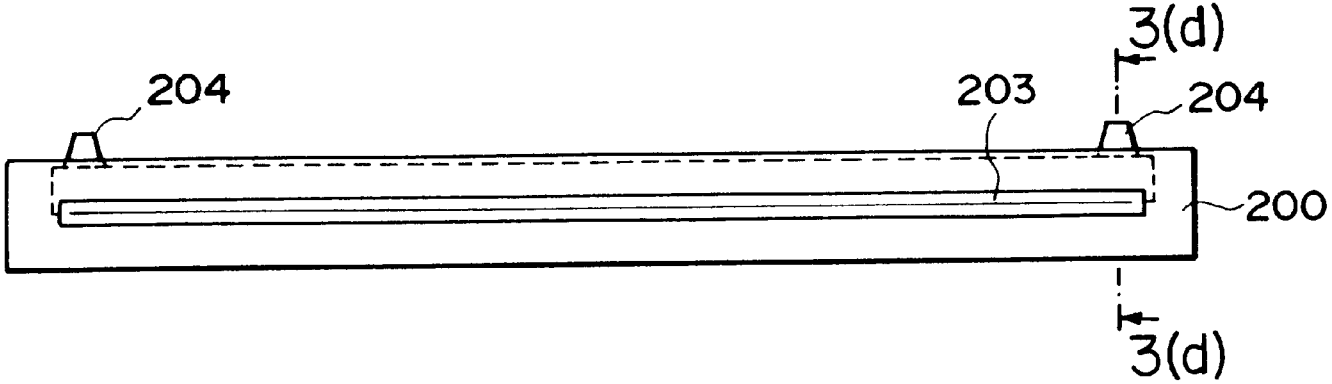
Figure 3C:
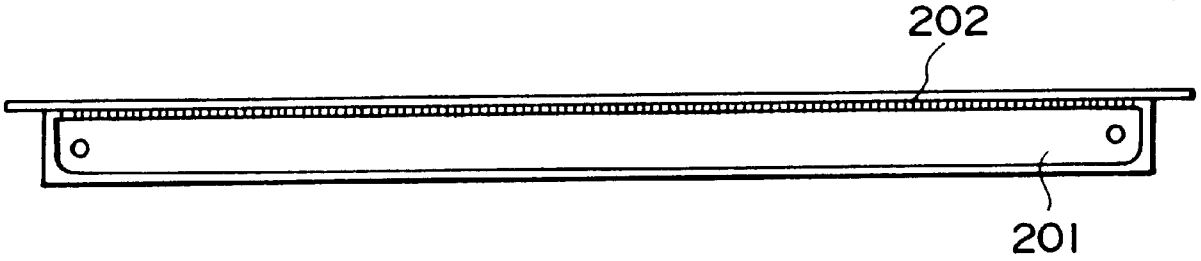
Figure 3D:
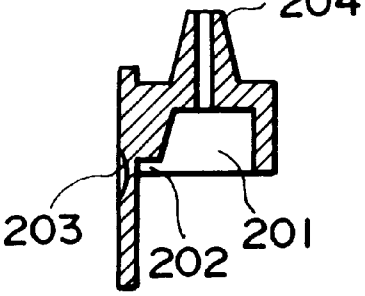

SHEET 3 OF 18
Fig. 3(d), change "x-x" to --3(d)-3(d)--.

Figure 13A:
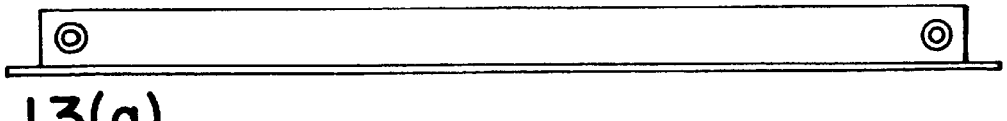
FIGS. 13(*a*)–13(*d*) schematically illustrates a top plate used in this invention.
Figure 13B:
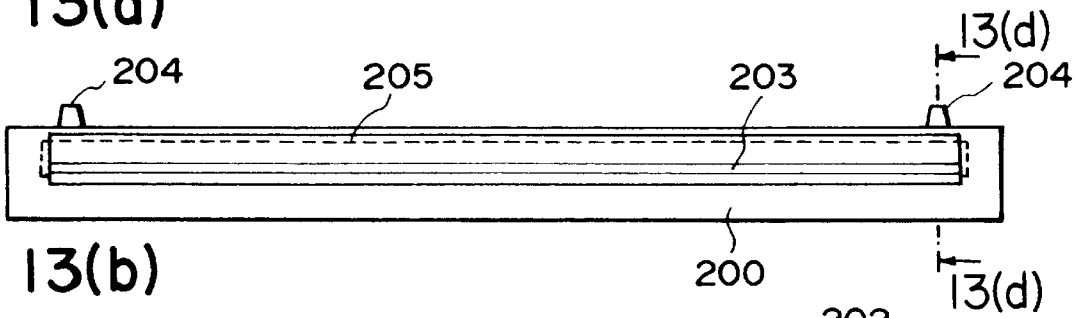
Figure 13C:
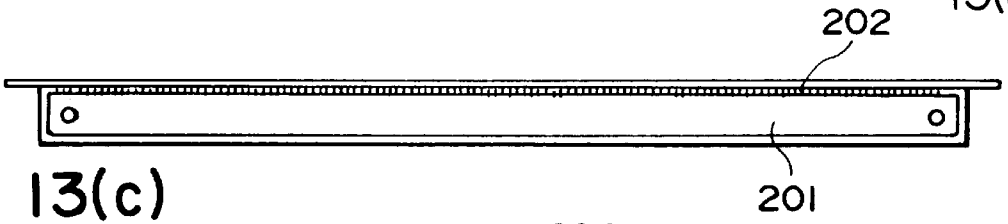
Figure 13D:
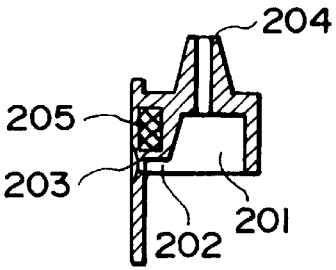
Figure 15A:
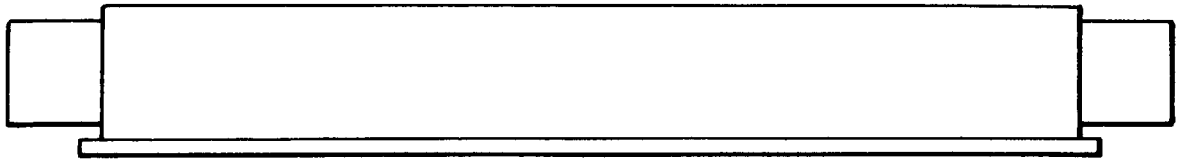
FIGS. 15(*a*)–15(*d*) schematically illustrates a top plate used in this invention.
Figure 15B:
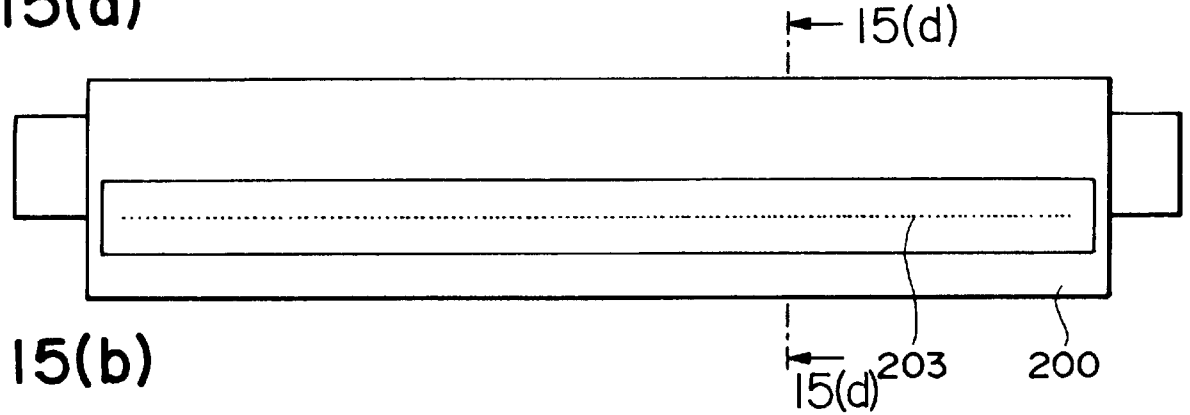
Figure 15C:
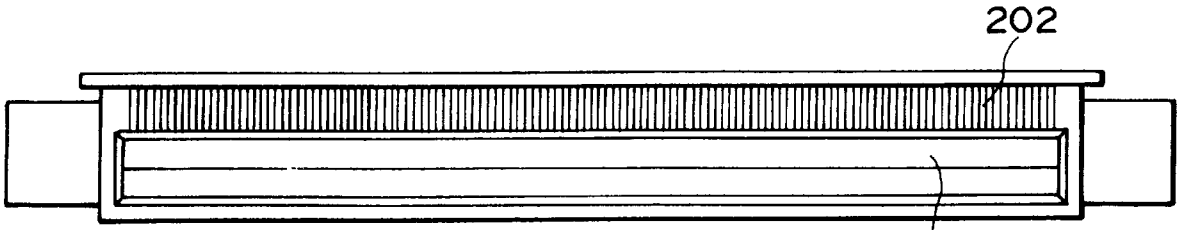
Figure 15D:
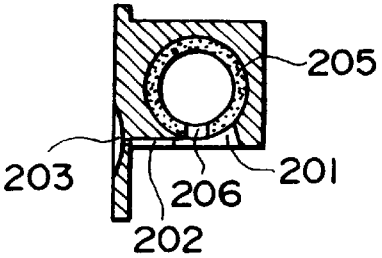

SHEET 13 OF 18
Fig. 13(d), change "x-x" to --13(d)-13(d)--.

COLUMN 2

Line 40, "is requires" should read --this requires--.

COLUMN 4

Line 23, "a schematic view" should read --schematic views--.

COLUMN 5

Line 62, "the all" should read --all--.

COLUMN 6

Line 36, "with" should read --is--; and
Line 61, "the is" should read --the ink is--.

COLUMN 7

Line 27, "the" (first occurrence) should be deleted.

UNITED STATES PATENT AND TRADEMARK OFFICE

CERTIFICATE OF CORRECTION

PATENT NO. : 5,933,163

DATED : August 3, 1999

INVENTOR(S) : YUTAKA KOIZUMI ET AL.

It is certified that error appears in the above-identified patent and that said Letters Patent is hereby corrected as shown below:

COLUMN 8

Line 44, "outlets," should read --outlet,--.

COLUMN 9

Line 7, "is" (1st occur.) should read --are--; and
Line 45, "results" should read --result--.

COLUMN 11

Line 13, "plat 200" should read --plate 200--.

COLUMN 14

Line 29, "a further embodiment will be" should read --depicts an ink jet cartridge which incorporates the present invention, and which will now be--.

COLUMN 15

Line 56, "bent 510" should read --vent 510--.

COLUMN 16

Line 43, "claim 4," should read --claim 1,--.

UNITED STATES PATENT AND TRADEMARK OFFICE

CERTIFICATE OF CORRECTION

PATENT NO. : 5,933,163

DATED : August 3, 1999

INVENTOR(S) : YUTAKA KOIZUMI ET AL.

It is certified that error appears in the above-identified patent and that said Letters Patent is hereby corrected as shown below:

COLUMN 17

Line 28, "claim 17," should read --claim 16,--.

Signed and Sealed this

Fifth Day of December, 2000

*Attest:*

*Attesting Officer*

Q. TODD DICKINSON

*Director of Patents and Trademarks*